US005531637A

United States Patent [19]

Kimura

[11] Patent Number: 5,531,637

[45] Date of Patent: Jul. 2, 1996

[54] AUTOMATIC CENTRIFUGAL FLUIDIZING BARREL PROCESSING APPARATUS

[75] Inventor: Akihiro Kimura, Nagoya, Japan

[73] Assignees: Kabushiki Kaisha Nagao Kogyo; Kimura Drawing Co., Ltd., both of Nagoya, Japan

[21] Appl. No.: 238,940

[22] Filed: May 6, 1994

[30] Foreign Application Priority Data

| | | | |
|---|---|---|---|
| May 14, 1993 | [JP] | Japan | 5-112602 |
| May 14, 1993 | [JP] | Japan | 5-112603 |
| May 14, 1993 | [JP] | Japan | 5-112604 |
| May 14, 1993 | [JP] | Japan | 5-112609 |
| May 14, 1993 | [JP] | Japan | 5-112694 |
| May 14, 1993 | [JP] | Japan | 5-112696 |

[51] Int. Cl.[6] ..... B24B 31/02

[52] U.S. Cl. ..... 451/329; 451/328; 451/5

[58] Field of Search ..... 451/5, 11, 32–35, 451/326, 328, 329; 241/175

[56] References Cited

U.S. PATENT DOCUMENTS

| | | | |
|---|---|---|---|
| 2,387,095 | 10/1945 | Shideler et al. | 451/329 |
| 3,474,574 | 10/1969 | Ohno | 451/329 |
| 3,513,604 | 5/1970 | Matsunaga et al. | 451/329 |
| 3,562,962 | 2/1971 | Ohno | 451/329 |
| 3,823,512 | 7/1974 | Kobayashi | 451/329 |
| 4,172,339 | 10/1979 | Balz | 451/329 |
| 4,242,838 | 1/1981 | Dreher | 451/329 |
| 4,308,693 | 1/1982 | Harper | 451/329 |
| 4,505,072 | 3/1985 | Kobayashi et al. | 451/329 |
| 4,638,600 | 1/1987 | Kobayashi et al. | 451/329 |
| 4,727,684 | 3/1988 | Kobayashi et al. | 451/329 |
| 4,807,403 | 2/1989 | Kobayashi et al. | 451/329 |
| 4,949,510 | 8/1990 | Kobayashi et al. | 451/329 |

FOREIGN PATENT DOCUMENTS

| | | |
|---|---|---|
| 4816295 | 3/1973 | Japan . |
| 5546822 | 4/1980 | Japan . |
| 62-152668 | 7/1987 | Japan . |
| 278253 | 3/1990 | Japan . |

*Primary Examiner*—Bruce M. Kisliuk
*Assistant Examiner*—Derris Banks
*Attorney, Agent, or Firm*—Oblon, Spivak, McClelland, Maier & Neustadt

[57] ABSTRACT

A horizontal full automatic centrifugal fluidizing barrel processing apparatus which does not damage working environment and offers superior working efficiency. When two disk members are rotated together with a revolutionary shaft, a planetary moving mechanism provided in one of the disk members revolves rotary shafts around the revolutionary shaft and rotates the rotary shafts on their axes. Rotary pinching mechanisms installed in the rotary shafts (a part of a barrel pinching mechanism) pinch and rotate airtight cylindrical barrels. Hydraulic cylinders (the remainder of the barrel pinching mechanism) actuate the rotary pinching mechanisms on the side of one of the disk members to release the pinch of the barrels. A barrel handling mechanism 10 carries a released barrel out of the apparatus and set an untreated barrel.

11 Claims, 21 Drawing Sheets

AUTOMATIC CENTRIFUGAL FLUIDIZING BARREL PROCESSING APPARATUS

BACKGROUND OF THE INVENTION

1. Field of the Invention

This invention relates to a centrifugal fluidizing barrel processing apparatus which can be driven automatically.

2. Description of the Related Art

In the conventional centrifugal fluidizing barrel polishing apparatus, although the actual polishing step is simple and finished in a short time, operations for changing barrel contents are complicated and require a long time, and it is difficult to keep the environment of the apparatus clean. To dissolve these problems, various proposals have been made as mentioned below.

Japanese Patent Unexamined Publication No.16295/1973 discloses a following construction. One-side ends of a plurality of processing cylinders which rotate on their axes around a horizontal revolutionary shaft are connected in a manner to permit relative rotation to a fore end of a feeder cylinder which revolves integrally with the revolutionary shaft. The other end of the feeder cylinder is communicated with one end opening of the revolutionary shaft through a hollow portion in the revolutionary shaft. Workpieces and polishing materials are continuously introduced from this one end opening of the revolutionary shaft. The polished contents are discharged to the outside from the other end openings of the processing cylinders.

Japanese Patent Unexamined Publication No. 78253/1990 discloses that processing cylinders are rotatably fixed to a revolving turret, and that the turret is swung on a horizontal shaft to discharge the polished contents of the processing cylinders to the outside.

Japanese Patent Unexamined Publication No. 46822/1980 and Japanese Patent Unexamined Publication No. 15668/1987 disclose a following construction. A turret fixed to a vertical revolutionary shaft rotatably holds a plurality of rotary shafts around the revolutionary shaft, and a stand and a lid portion are provided to each rotary shaft. A processing barrel which is filled with unpolished contents and has an upper end opening is placed on each stand, and the upper end opening of each processing barrel is sealed with each lid portion by driving a clamp apparatus which can rotate and revolve together with each rotary shaft and by sliding one of the stand and the lid portion in an axial direction. With the barrels sealed, the revolutionary shaft and each of the rotary shafts are synchronously revolved and rotated, so as to rotate and revolve the processing barrels, thereby conducting centrifugal fluidizing barrel polishing. After the barrel polishing is finished, the one of each stand and each lid portion is slided in the opposite direction to the above direction so as to allow each of the lid portion to be removed from each of the processing barrels. Then, the processing barrels after the polishing treatment are removed from the stands by a handling apparatus, and new processing barrels are loaded on the vacant stands by a handling apparatus. Then, the upper end opening of each processing barrel is sealed by sliding each lid portion again in the axial direction, and at the same time each processiing barrel is pinched in the axial direction. Then, a next polishing cycle is executed. By the way, in these publications, the rotary shafts are driven by the revolutionary shaft through chains.

However, according to the former two publications, it is not east to remove the polished contents stuck to the inside of the processing cylinders completely. On the other hand, according to the latter two publications, since the processing barrels can be removed from the apparatus and washed separately at the outside of the apparatus, it is easy to remove polished contents and introduce a predetermined amount of unpolished materials, but these apparatus still have following disadvantages.

The first problem is as follows. Since polishing liquid and polishing powder stuck to the lower surface of each of the lid portions are dropped and scattered in removing each processing barrel having an upper end opening, the surface of the apparatus below the lid portions and the floor get wet or dirty. Therefore, the working environment is worsened, and in some cases, the polishing liquid and polishing powder are stuck to the rotating and revolving parts of the apparatus, which decreases the durability of the apparatus.

Further, at the time of taking processing barrels filled with polished materials out of the apparatus, or installing processing barrels filled with unpolished materials to the apparatus, the polishing liquid and the polishing powder often leak from the apparatus and cause the same problem as above, Of course, this problem is reduced by increasing the depth of the barrels, decreasing the volume of the barrel contents or decreasing the transfer speed of the barrels. As a result, however, the productivity is decreased and the size of the apparatus is increased due to the increase in mass to be revolved and rotated.

Further, since the rotation and revolution of the processing barrels are at high speeds, clamp mechanisms which rotate and revolve with the rotary shafts must heavily press the lid portions against the barrels, in order to prevent the barrel contents from leaking to the outside because each lid portion and each lid portion are radially slided from each other by the torque and centrifugal force. Therefore, the clamp mechanisms are complicated in construction and the mass to be revolved and rotated is inevitably increased.

Further, the above conventional barrel apparatus are vertical centrifugal fluidizing barrel polishing apparatus in which the revolutionary shaft and the rotary shafts are provided vertically. In these vertical apparatus, it is difficult to increase the volume of the barrel contents by increasing the depth of the barrels, because the polishing performance is varied widely due to the gravity during the revolution and the rotation. A horizontal centrifugal fluidizing barrel polishing apparatus in which the revolutionary shaft and the rotary shafts are provided horizontally can increase barrel contents by increasing the depth of the barrels, but these horizontal apparatus cannot employ the barrels having the above construction because barrel contents are leaked in installing or removing the barrels.

The present invention has been conceived in view of the above problem. It is a primary object of the present invention to provide a horizontal full automatic centrifugal fluidizing barrel processing apparatus in which work environment is improved without increasing the size of the apparatus or decreasing the productivity.

The second problem is as follows. According to the above publications, there is a need to provide each rotary shaft with a planetary moving mechanism for rotating the rotary shaft by transmitting the driving torque of the revolutionary shaft to the rotary shaft. However, since the polishing liquid, the polishing powder and the like are scattered around the apparatus, these polishing liquid and polishing powder adhere to the planetary moving mechanisms. As a result, the planetary moving mechanisms are worn away, their lifetime is decreased, and the noise is increased.

The present invention has been conceived in view of the above second problem. Therefore, it is a second object of the present invention to provide a full automatic centrifugal fluidizing barrel processing apparatus having a construction in which planetary moving mechanisms and barrel pinching mechanisms are free from stains.

The third problem is as follows. The clamp mechanisms disclosed in Japanese Patent Publication No. 152668/1987 need that a hydraulic cylinder must be installed on the turret (i.e., the revolving disk) and that hydraulic pressure to be applied to the hydraulic cylinder must be controlled. As a result, a hydraulic pipeline system is complicated, the mass to be revolved around the revolutionary shaft is increased, and the rotating speed is decreased because of the increase in centrifugal force. Further, it is difficult to apply these clamp mechanisms to apparatus other than a vertical apparatus in which the revolutionary shaft is provided in a vertical direction.

On the other hand, the clamp mechanisms disclosed in Japanese Patent Unexamined Publication No. 46822/1980 require that more complicated mechanisms be rotated and revolved, and that each rotary shaft hang a processing barrel. Accordingly, these clamp mechanisms are applicable only to vertical apparatus in which the revolutionary shaft is provided vertically.

These vertical centrifugal fluidizing barrel polishing apparatus cannot increase the depth of processing barrels owing to the effect of gravity during the rotation and revolution polishing. Accordingly, there is a limit in increasing the capacity of barrels.

The present invention has been conceived in view of the above problem. It is a third object of the present invention to provide a full automatic centrifugal fluidizing barrel processing apparatus which has a simple construction, superior reliability and durability, and reduced mass to be revolved, and is provided with a barrel pinching mechanism applicable to a horizontal apparatus.

SUMMARY OF THE INVENTION

According to the present invention, a revolution driving source revolves a revolutionary shaft having a pair of disk members and at the same time drives a planetary moving mechanism, and the planetary moving mechanism rotates a plurality of pairs of rotary shafts on parallel axes around the revolutionary shaft. A barrel pinching mechanism detachably pinches engaging centering portions on the both ends of airtight cylindrical barrels by moving in the longitudinal direction pinching shafts installed in the pairs of rotary shafts. A barrel handling mechanism carries out a treated barrel which has been released from the barrel pinching mechanism at a predetermined stop phase of the disk members, and carry in an untreated barrel to be installed.

Each barrel is fed with workpieces and polishing materials on the inside and then sealed. The sealed barrel is handled by a barrel handling mechanism and pinched by the pinching shafts.

As mentioned in the above, in the full automatic centrifugal fluidizing barrel processing apparatus of the present invention, since untreated barrels are sealed beforehand, the barrels can be easily handled and pinched by pairs of pinching shafts. In detail, the apparatus of the present invention has the following merits.

(a) Since the barrels are removable, contents can be introduced and removed from the barrels and the barrels can be cleaned at the outside of the apparatus. Therefore, the working efficiency is drastically improved and the environment around the apparatus is not damaged.

In the case where the barrels are fixed to the apparatus, it must be conducted in the order at the apparatus to open the barrels, remove the contents, clean the barrels, introduce new contents, and seal the barrels. Therefore, it takes a lot of time and it is difficult to automate the operations in view of space. In the case of the present invention, because the barrels are removable, in respect of the apparatus it only takes the time for installing the barrels and the time for removing the barrels, and accordingly the working efficiency of the apparatus is drastically improved. Further, the apparatus can be easily automated, because the above various operations can be conducted separately at the outside of the apparatus and then the barrels are transferred to the apparatus.

(b) Since the barrels are always installed to and removed from the apparatus in a sealed state, the polishing liquid, polishing powder, and the like are completely prevented from being dropped or scattered on the surface of the apparatus and the floor, and therefore an excellent working environment can be obtained. Further, the polishing liquid, the polishing powder and the like are prevented from decreasing the durability by sticking to the rotating and revolving parts of the apparatus.

(c) Since the barrels are always installed to and removed from the apparatus in a sealed state, the barrels can be installed or removed in a short time, and therefore the working efficiency of the apparatus is further improved.

(d) Since the barrels are always installed to and removed from the apparatus in a sealed state, the barrel handling efficiency is considerably high particularly in the case of a horizontal centrifugal fluidizing barrel processing apparatus in which the revolutionary shaft and the pinching shafts are provided horizontally. As a result, the working efficiency of the apparatus is also high. Further, the horizontal apparatus can have a larger volume of contents to be polished when compared to the vertical barrel processing apparatus, because workpieces are not deposited deep in the barrels even if the depth of the barrels is increased.

(e) Each pair of pinching shafts only have to prevent a processing barrel from slipping off by centrifugal force, and do not need to press the lid portion against the barrel having an upper end opening in contrast to those of the conventional apparatus. Therefore, the barrel pinching mechanism to be revolved and rotated can be reduced in size and weight, and simplified in construction. In addition, the mass to be revolved and rotated can be decreased, and the size of the apparatus can be decreased.

In a preferred embodiment, the barrel handling mechanism conveys the barrels below the revolutionary shaft by a barrel carrying conveyor in an approximately horizontal direction which is perpendicular to the revolutionary shaft, and the barrels are transferred between the conveyor and the barrel pinching mechanism. Since the conveyor is provided below the revolutionary shaft of the full automatic centrifugal fluidizing barrel processing apparatus, the floor area required can be sharply decreased.

In each barrel according to a further preferred embodiment of the present invention, a main cylindrical portion having an opening in parallel to the axis of the main cylindrical portion is covered with a lid portion, and an elastic sealing layer is formed on a contact surface of at least one of a pair of dovetail flanges extending respectively from the main cylindrical portion and the lid portion. The both dovetail flanges are pinched by a clamp member having a dovetail groove. In this case, the operations to seal or open the opening are simple and a superior sealing effect is obtained.

Further, when centrifugal forge caused by the rotation of the barrel is applied on the clamp member, the dovetail groove of the clamp member urges the dovetail flanges in a pinching direction. As a result, the pinching force on the elastic sealing layer is increased and accordingly the sealing effect is further enhanced.

In a still further preferred embodiment, each pinching shaft of the barrel pinching mechanism pinches a barrel by being urged by a spring provided in a rotary shaft. At the time of releasing the pinch of the barrel, the end of the pinching shaft on the opposite side to the barrel pinching side is stopped to face a pinch releasing actuator, and the pinch releasing actuator moves the end of the pinching shaft on the opposite side to the barrel pinching side into the opposite direction to the barrel pinching direction, thereby releasing the barrel. In this case, the mass to be revolved is decreased and accordingly the size of the apparatus is decreased. In this case, the construction of the barrel pinching mechanism is simplified and accordingly, the reliability is improved. Further, a horizontal centrifugal fluidizing barrel processing apparatus can be automated.

In a still further preferred embodiment, a sun gear, rotary gears, and planetary gears are provided in an airtight gear room in one of the disk members. The sun gear attached to the revolutionary shaft in a manner to permit relative rotation and fixed to a frame rotates the rotary shafts by way of the planetary gears.

Namely, in this preferred embodiment, a rotation driving mechanism constituted by a planetary gear mechanism is provided in one of the disk members for pinching barrels, and at the same time, a coupling ring for supporting the sun gear supports the axis of the end surface of the one of the disk members on the opposite side to tile barrel pinching side.

Owing to this construction, dust is prevented from entering into the barrels and at the same time, the apparatus achieves a simple construction and a small size. Further, the planetary moving mechanism and the barrel pinching mechanism achieve simple and superior lubrication by an oil bath.

BRIEF DESCRIPTION OF THE DRAWINGS

Further objects and advantages of the present invention will be apparent from the following description, reference being had to the accompanying drawings wherein preferred embodiments of the present invention are clearly shown.

Figure 1:
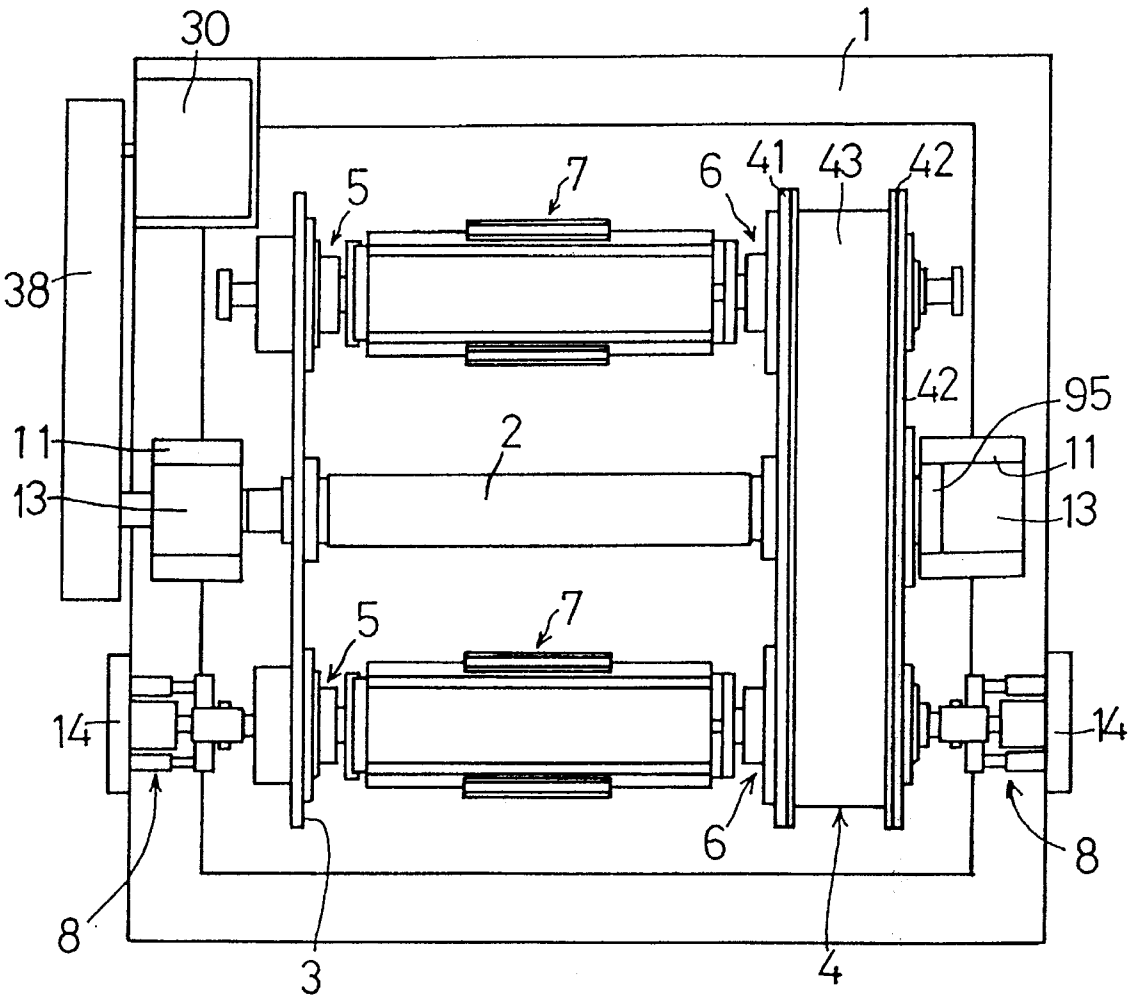

IN THE DRAWINGS:

FIG. 1 is a plan view of a horizontal full automatic centrifugal fluidizing barrel processing apparatus according to a first preferred embodiment of the present invention.

Figure 2:
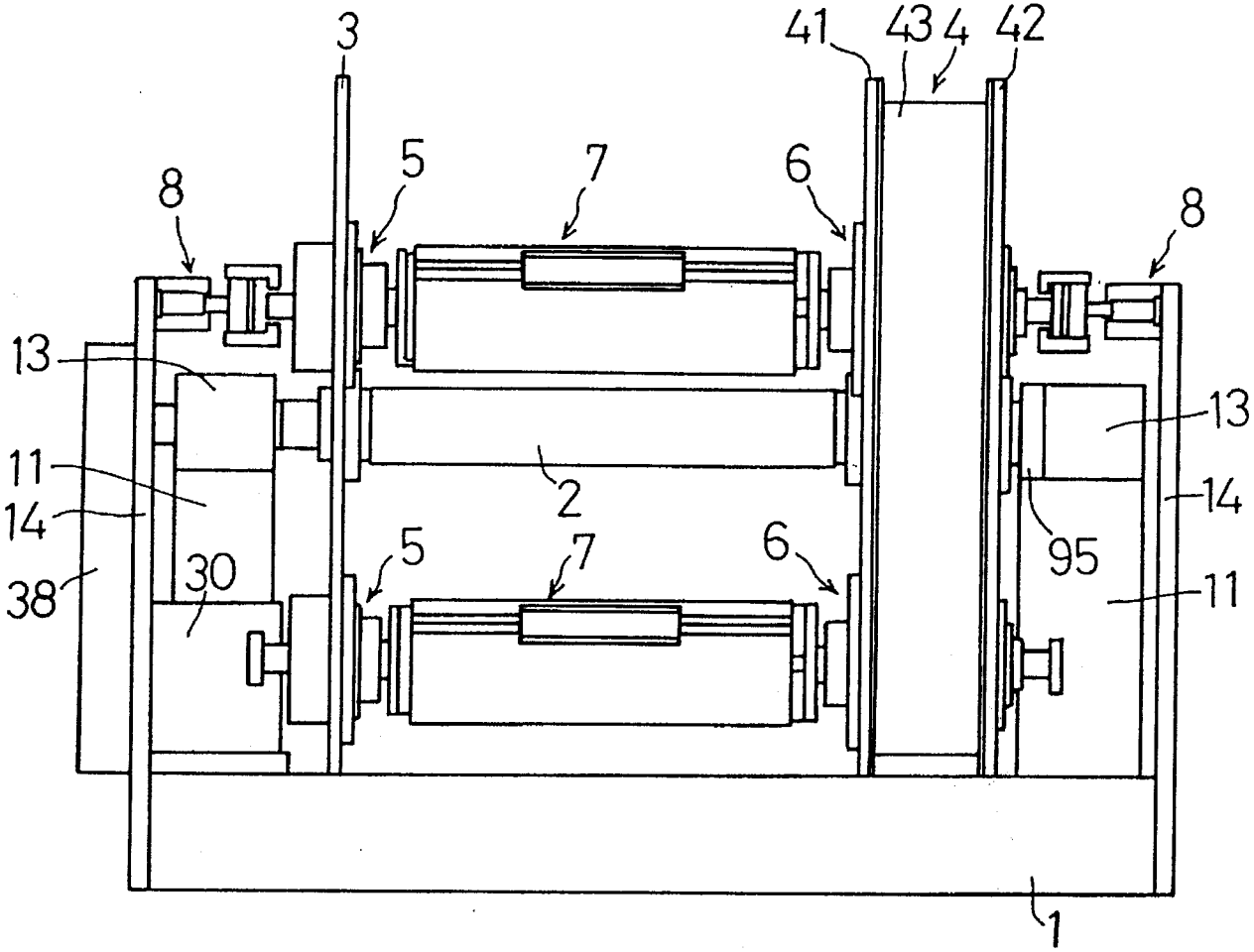

FIG. 2 is a front view of the horizontal full automatic centrifugal fluidizing barrel processing apparatus according to the first preferred embodiment of the present invention.

Figure 3:
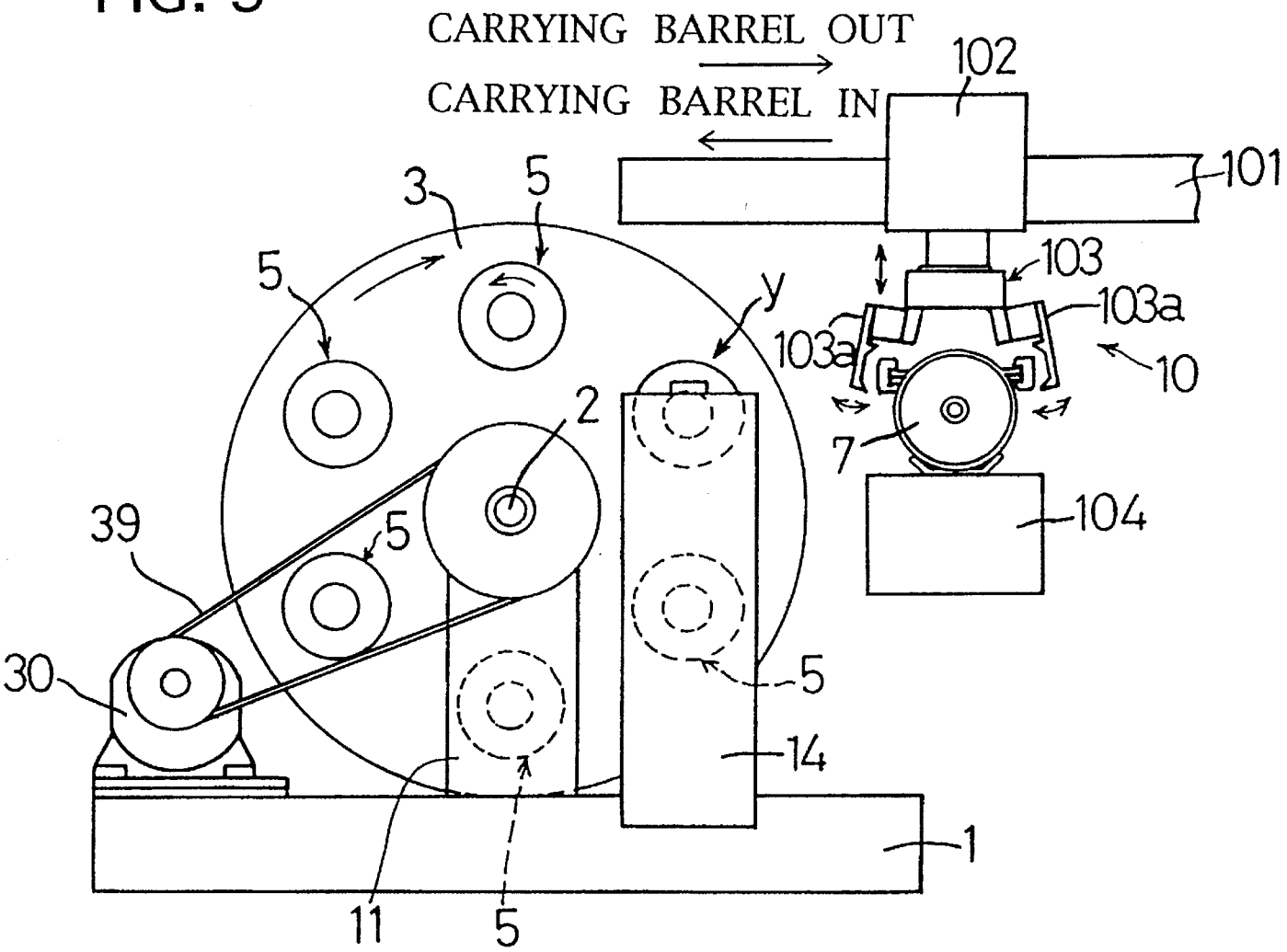

FIG. 3 is a side view of the horizontal full automatic centrifugal fluidizing barrel processing apparatus according to the first preferred embodiment of the present invention.

Figure 4:
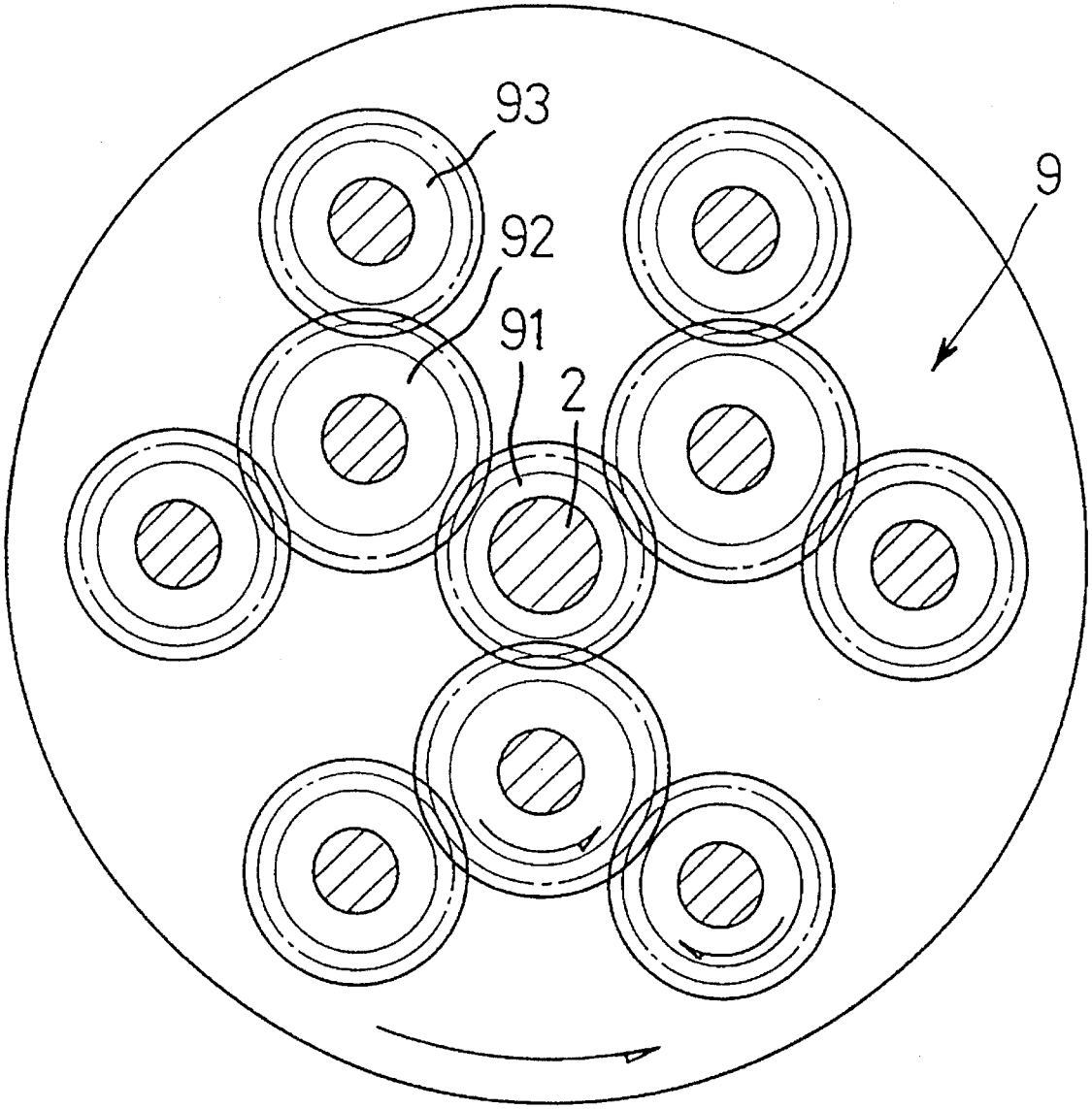

FIG. 4 is an explanatory drawing of a planetary gear mechanism according to the first preferred embodiment of the present invention.

Figure 5:
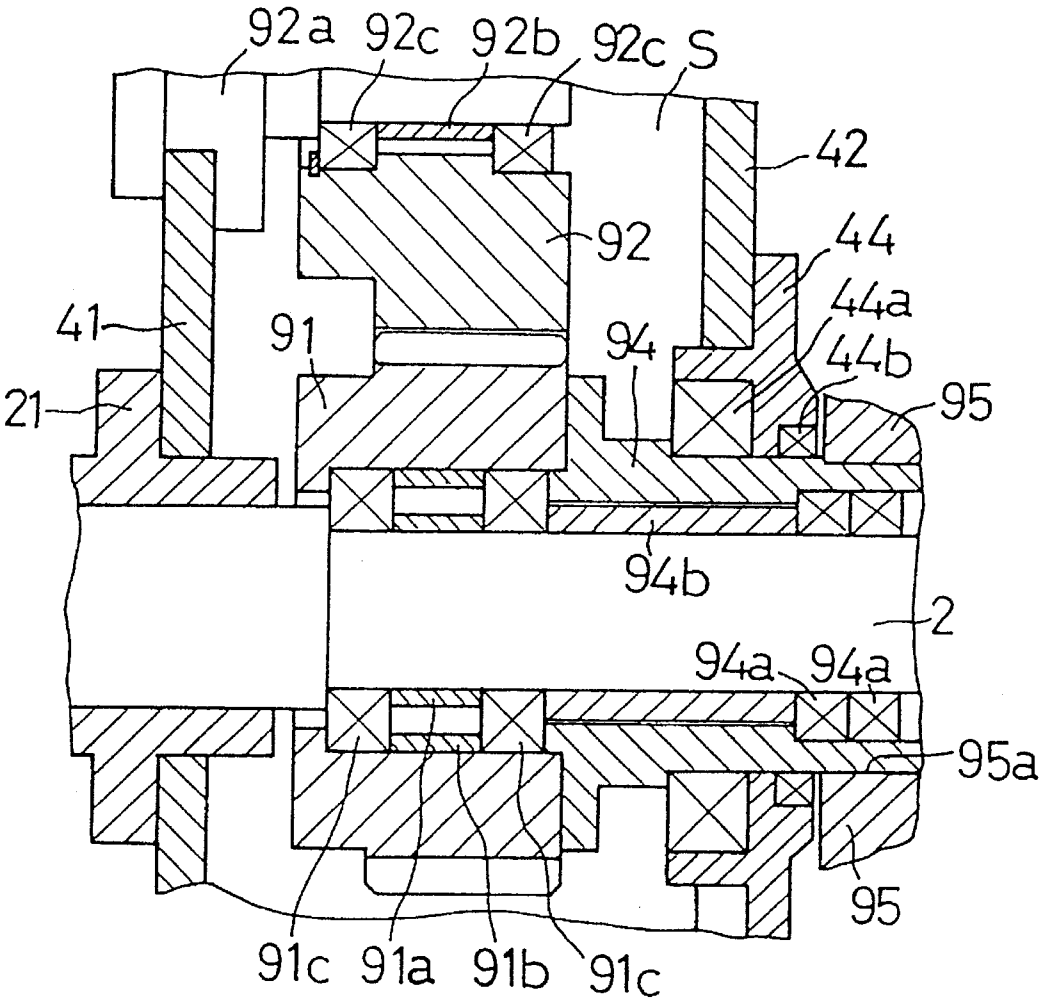

FIG. 5 shows an enlarged axial cross section of a central part of the cylindrical member shown in FIG. 1.

Figure 6:
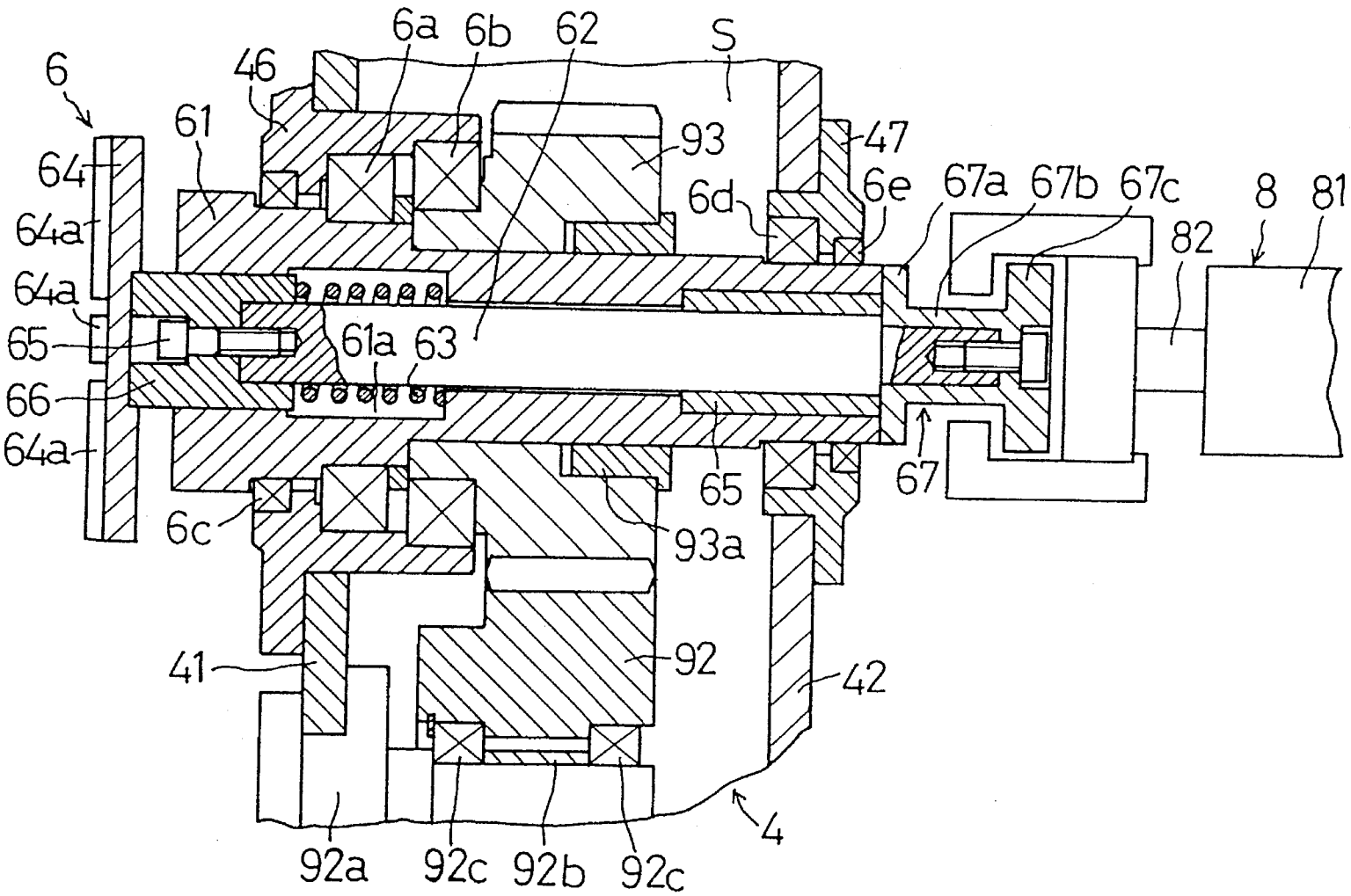

FIG. 6 shows an enlarged axial cross section of a part of the cylindrical member around a rotary shaft and a rotary pinching mechanism shown in FIG. 1.

Figure 7:
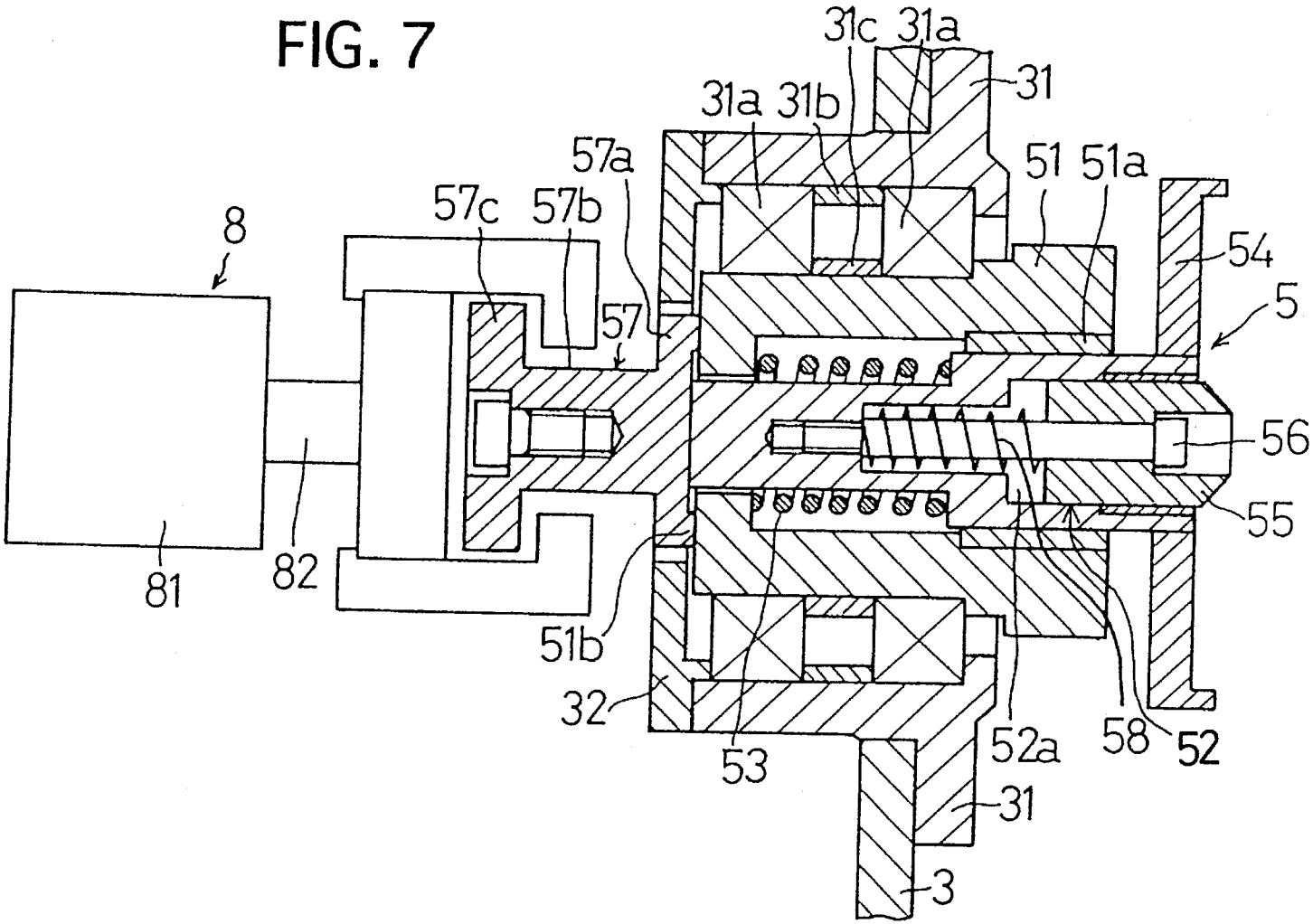

FIG. 7 shows an enlarged axial cross section of a part of the disk member shown in FIG. 1.

Figure 8:
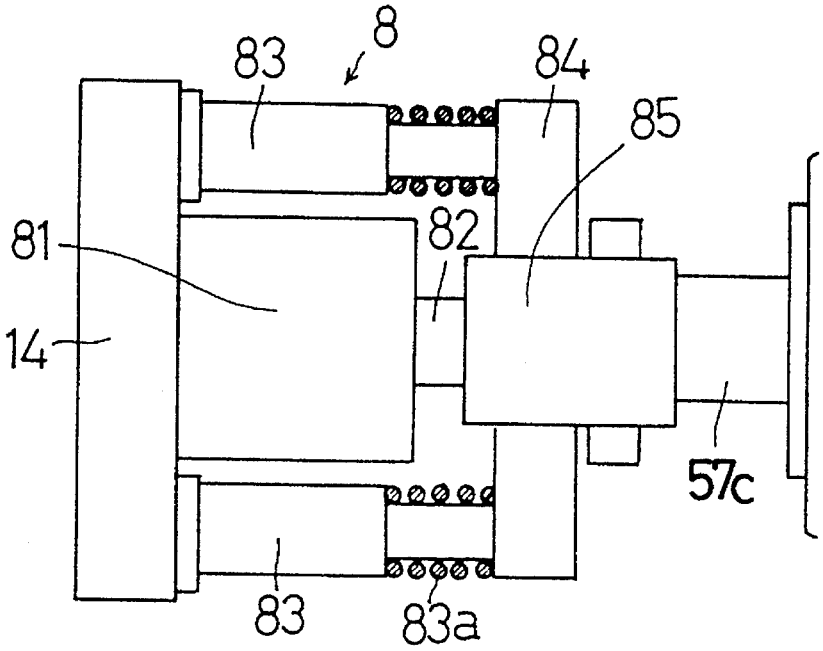

FIG. 8 is a plan view of a hydraulic cylinder shown in FIG. 1.

Figure 9:
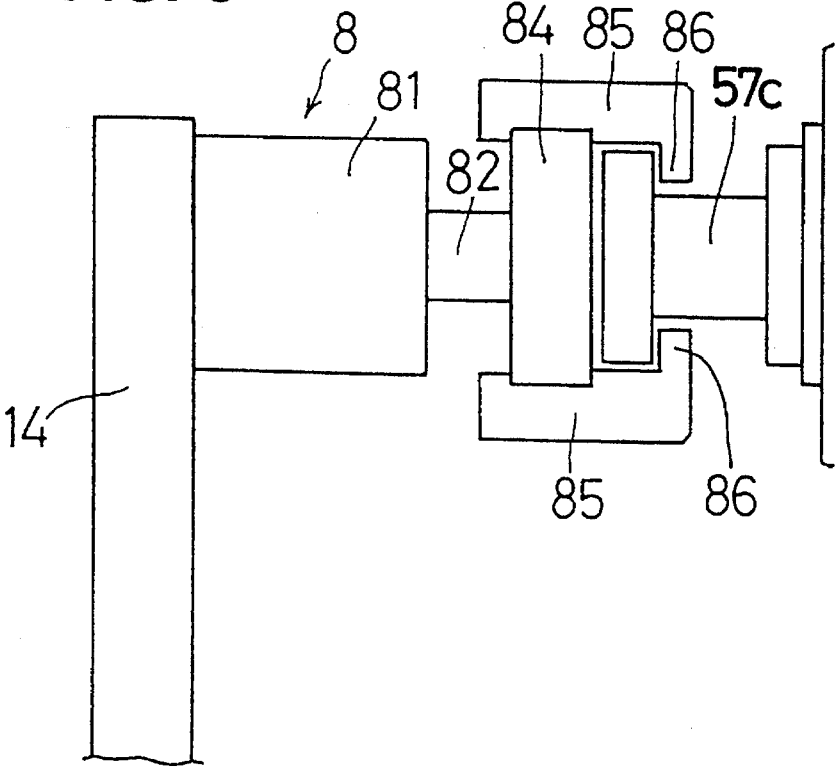

FIG. 9 is a front view of the hydraulic cylinder shown in FIG. 8.

Figure 10:
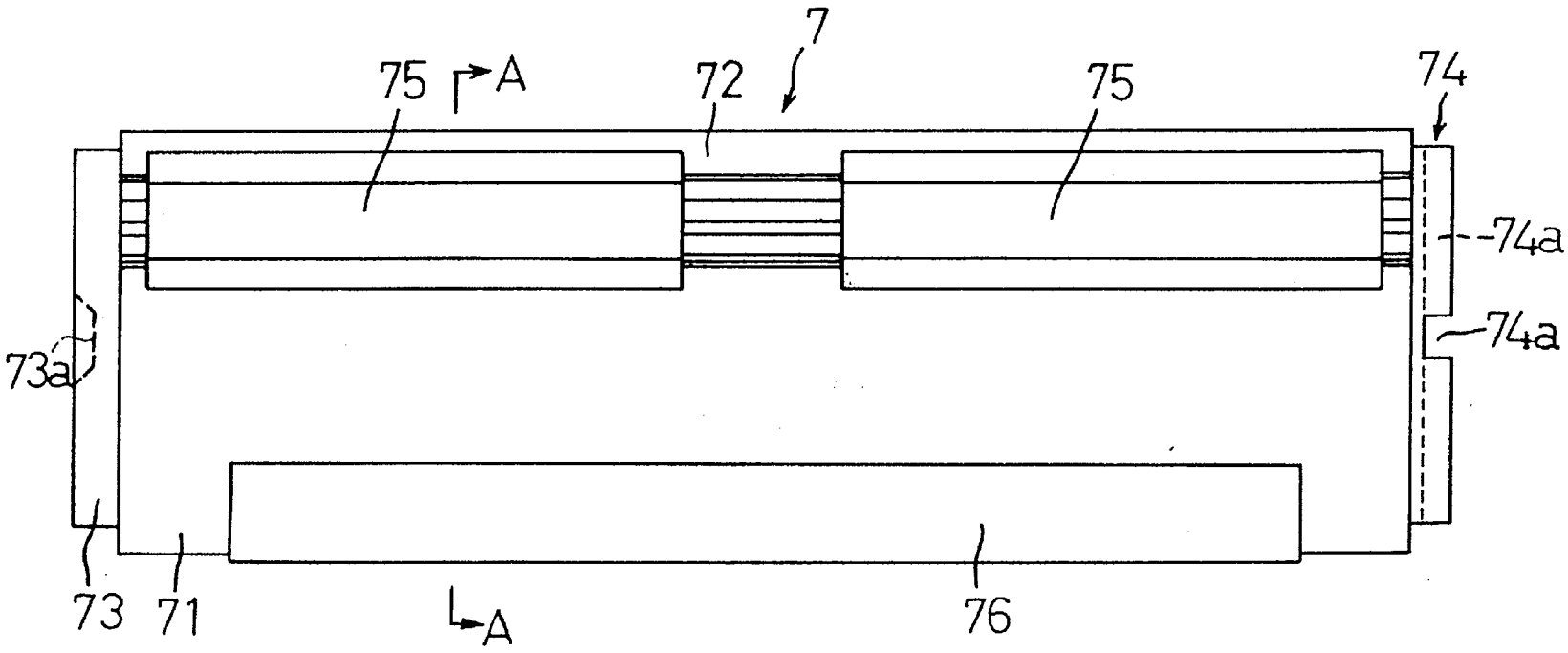

FIG. 10 is a front view of one barrel shown in FIG. 1.

Figure 11:
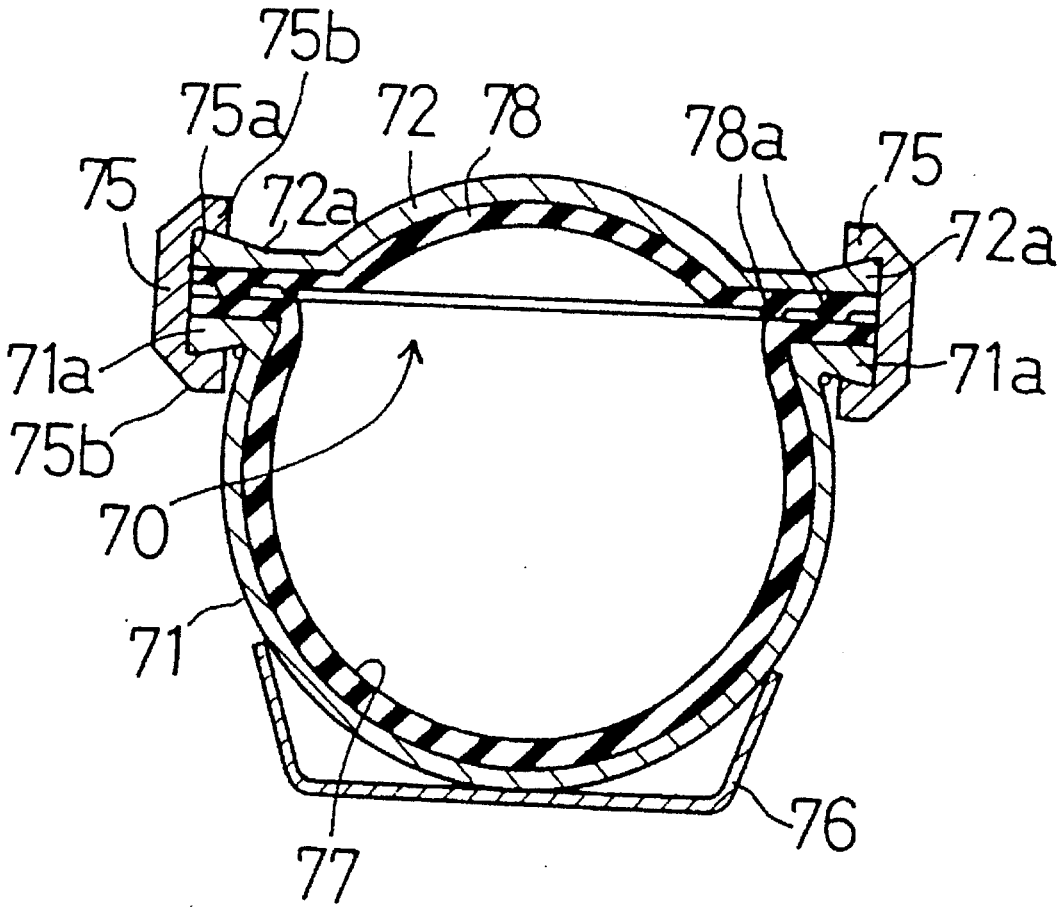

FIG. 11 shows a cross section taken on the line A—A in FIG. 10.

Figure 12:
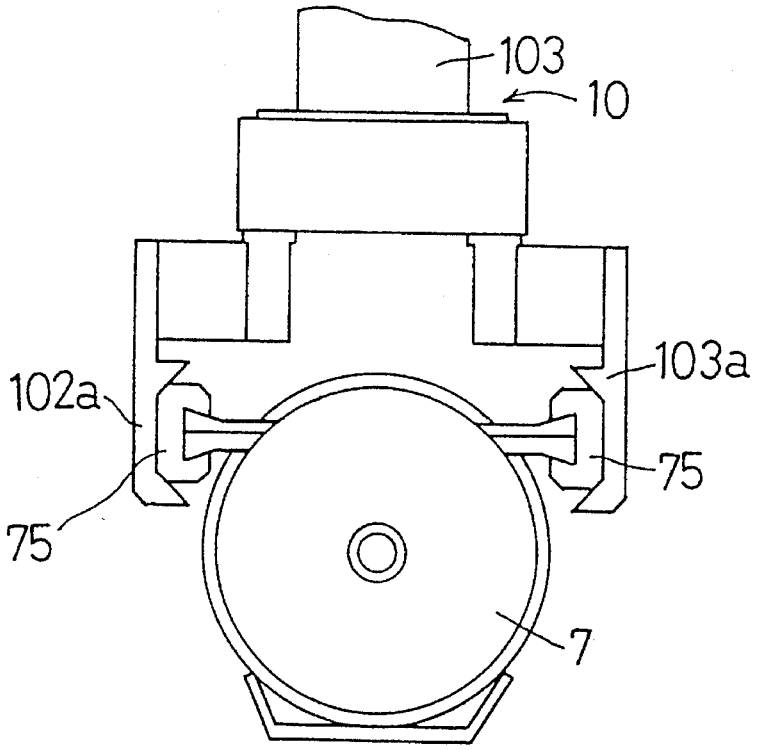

FIG. 12 is a side view of a barrel handling apparatus shown in FIG. 1 wherein a barrel is held by a barrel holding portion.

Figure 13:
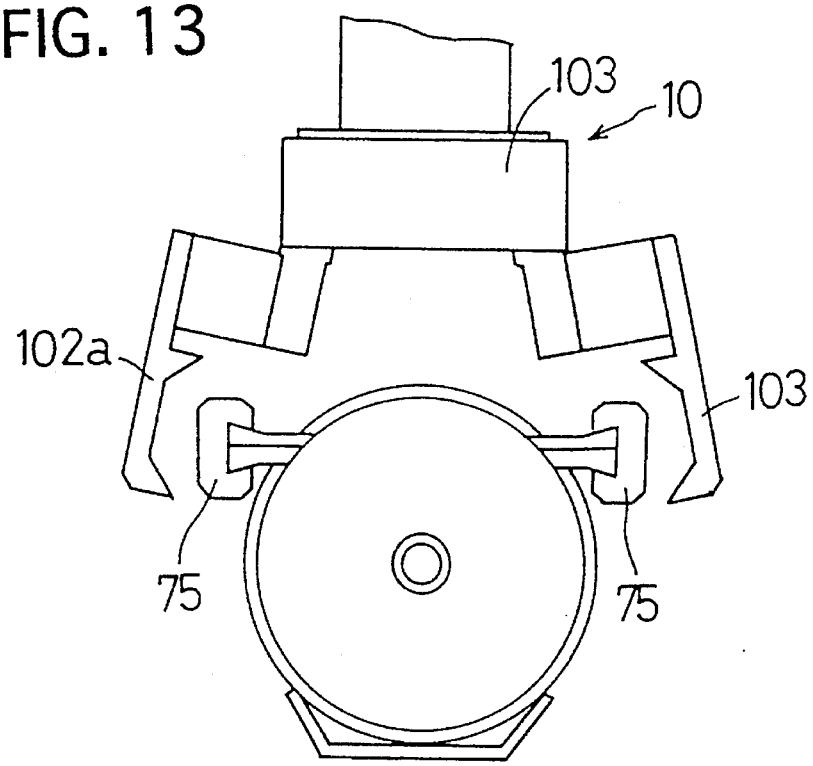

FIG. 13 is a side view of a barrel handling apparatus shown in FIG. 1 wherein a barrel is released from a barrel holding portion.

Figure 14:
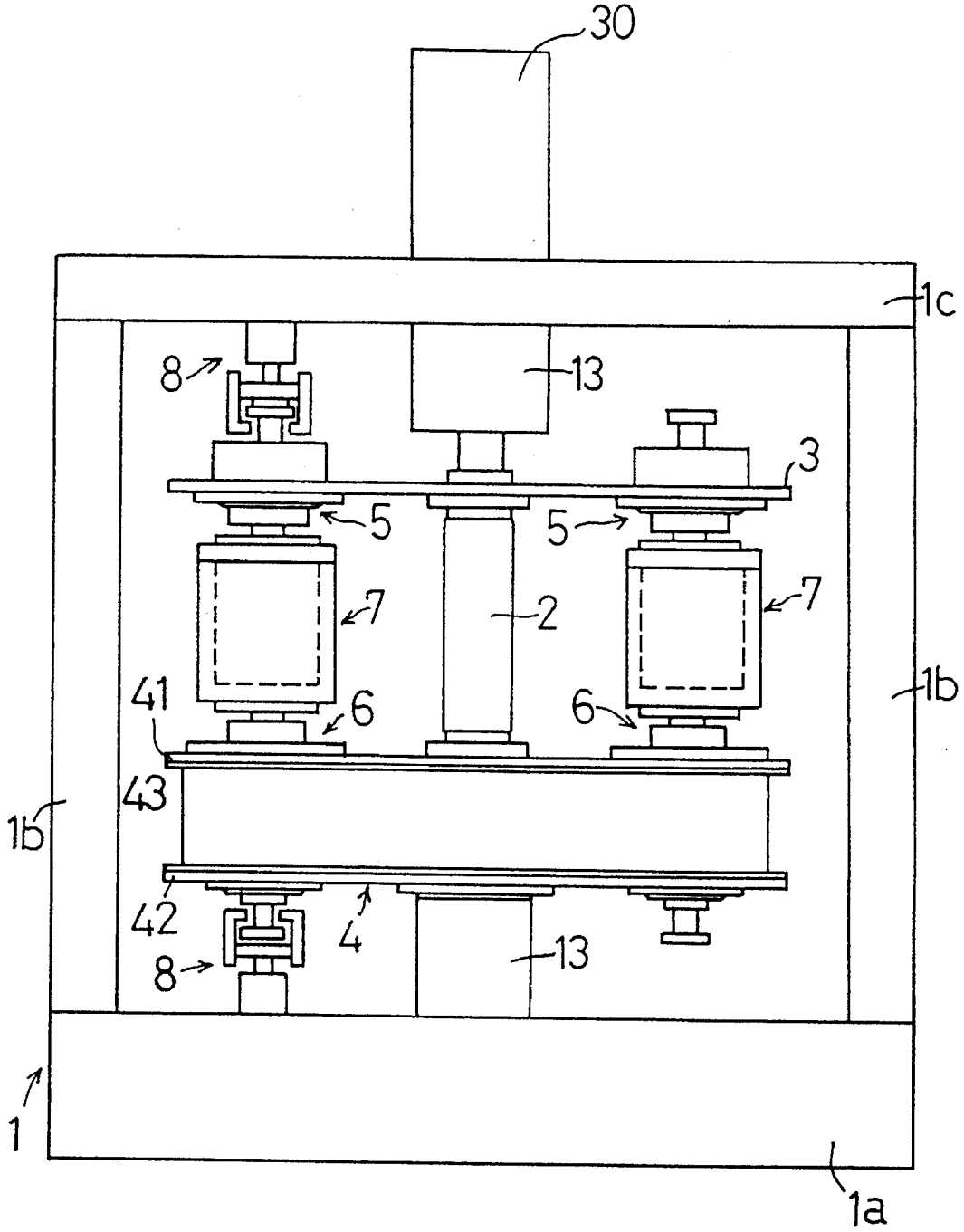

FIG. 14 is a front view of a vertical full automatic centrifugal fluidizing barrel processing apparatus according to a second preferred embodiment of the present invention.

Figure 15:
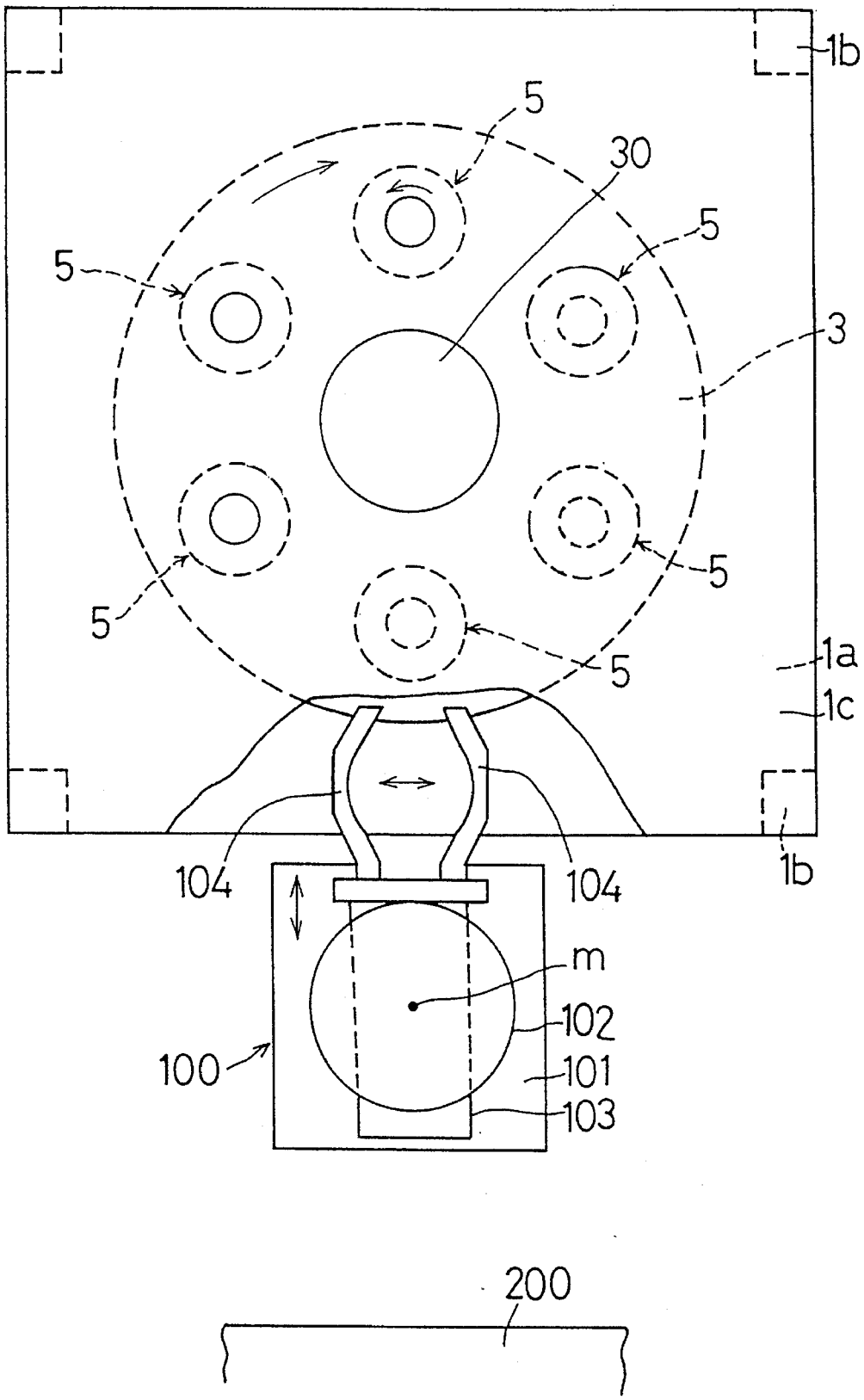

FIG. 15 is a plan view of the vertical full automatic centrifugal fluidizing barrel processing apparatus according to the second preferred embodiment of the present invention.

Figure 16:
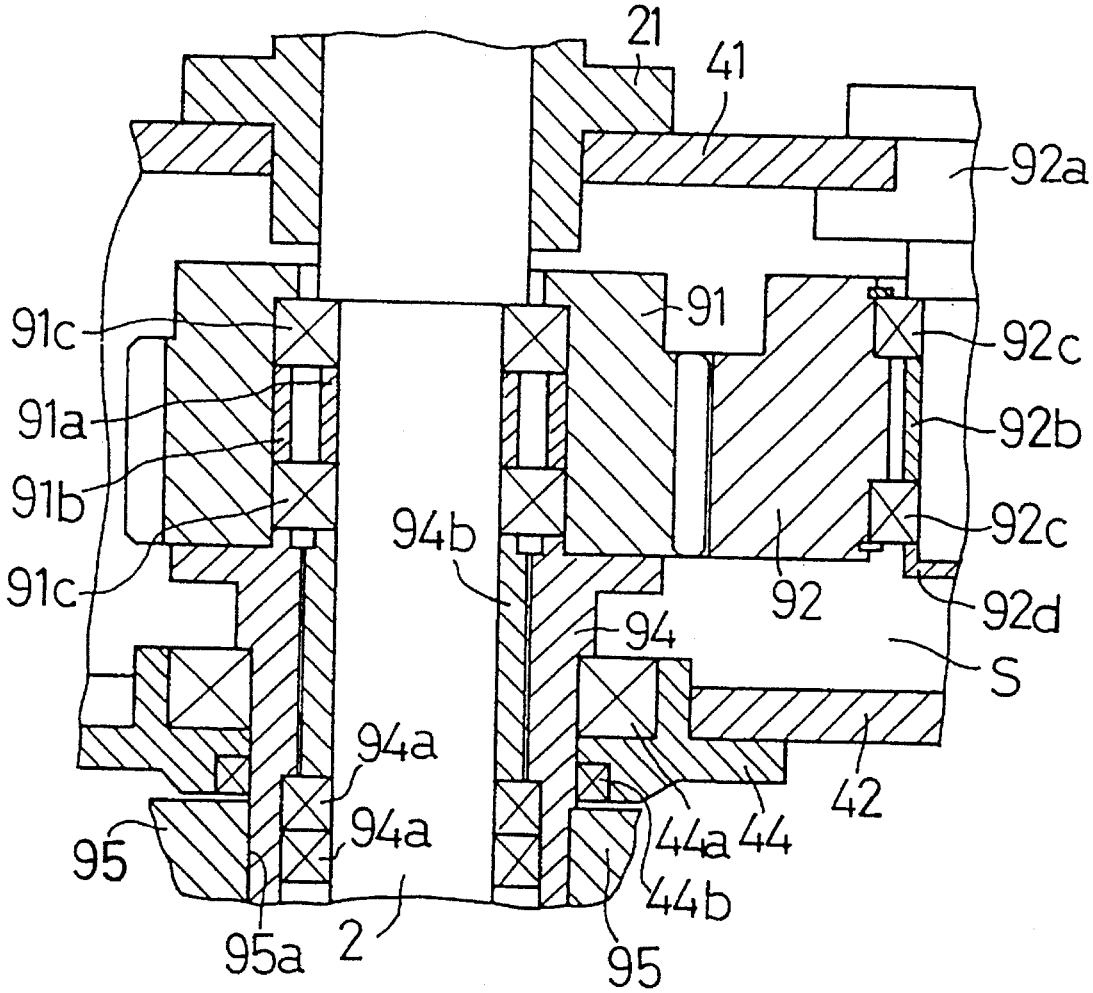

FIG. 16 shows an enlarged axial cross section of a part of the cylindrical member of FIG. 14.

Figure 17:
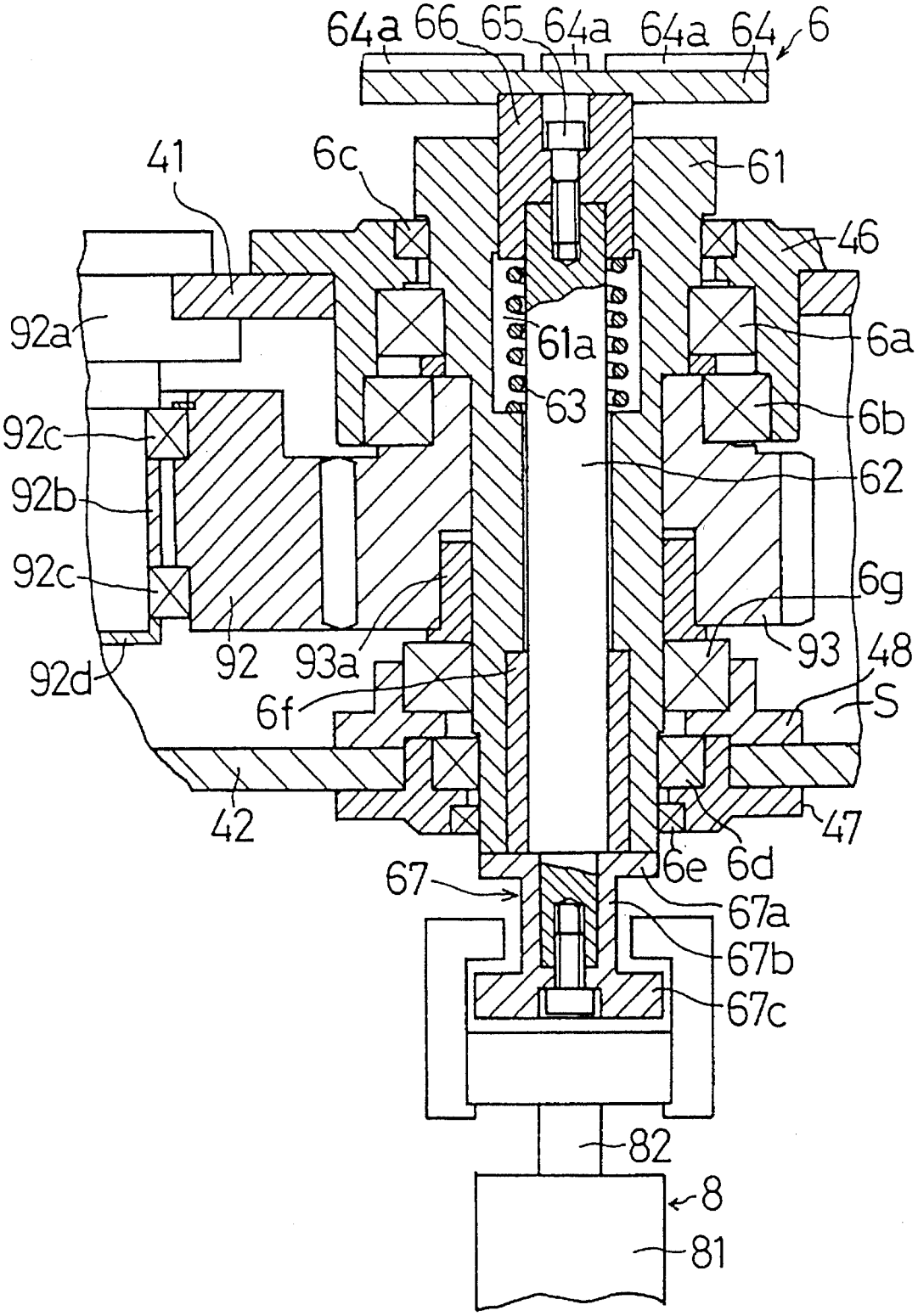

FIG. 17 shows an enlarged axial cross section of a part of the cylindrical member of FIG. 14.

Figure 18:
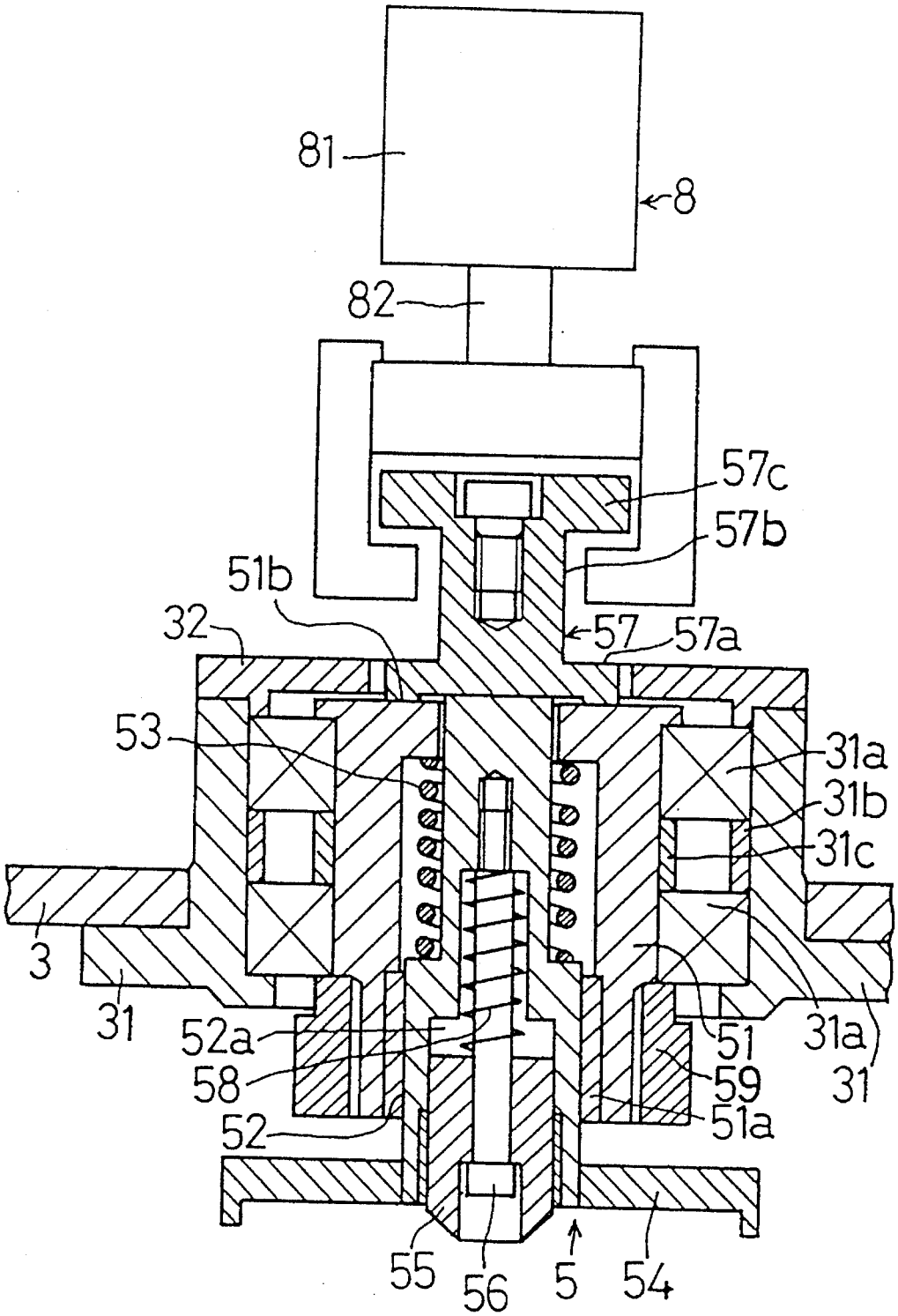

FIG. 18 shows an enlarged axial cross section of a part of the disk member of FIG. 14.

Figure 19:
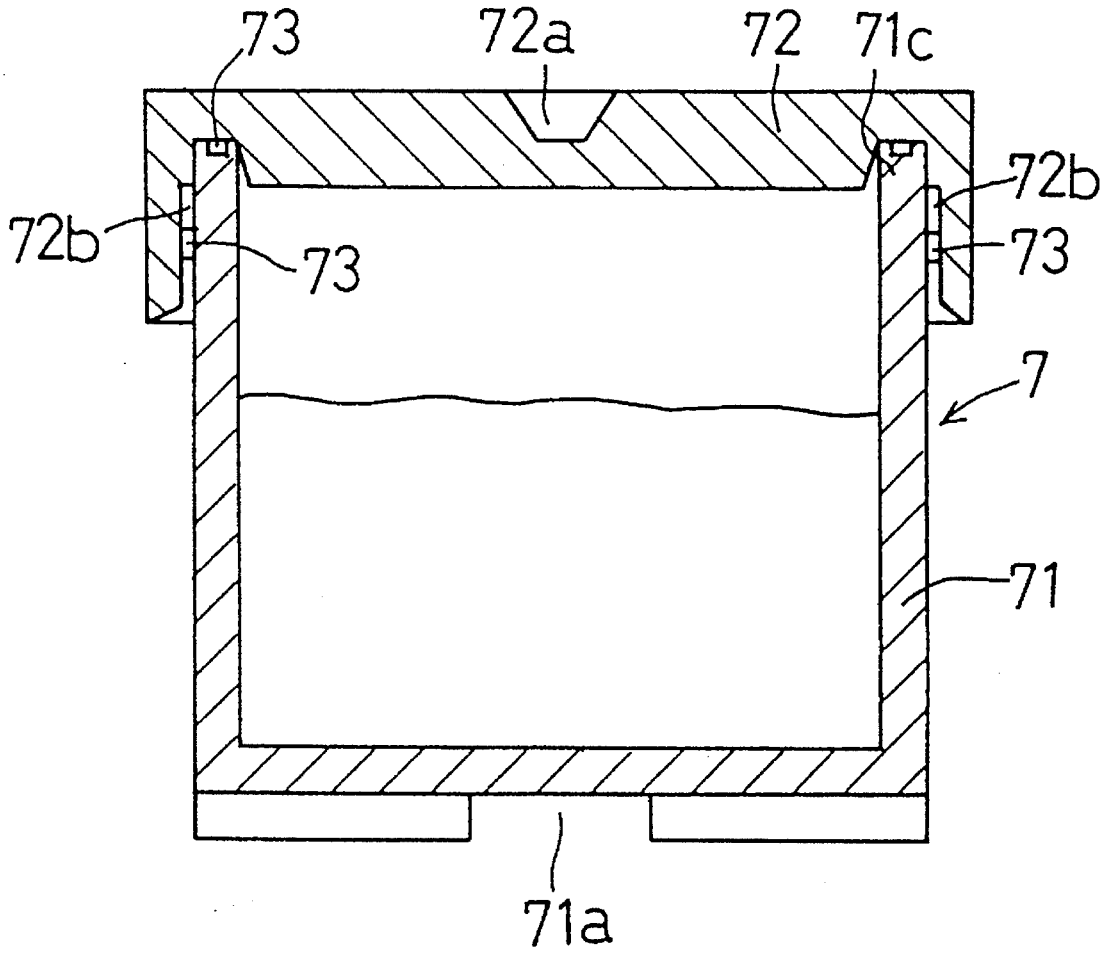

FIG. 19 shows an axial cross section of one barrel of FIG. 14.

Figure 20:
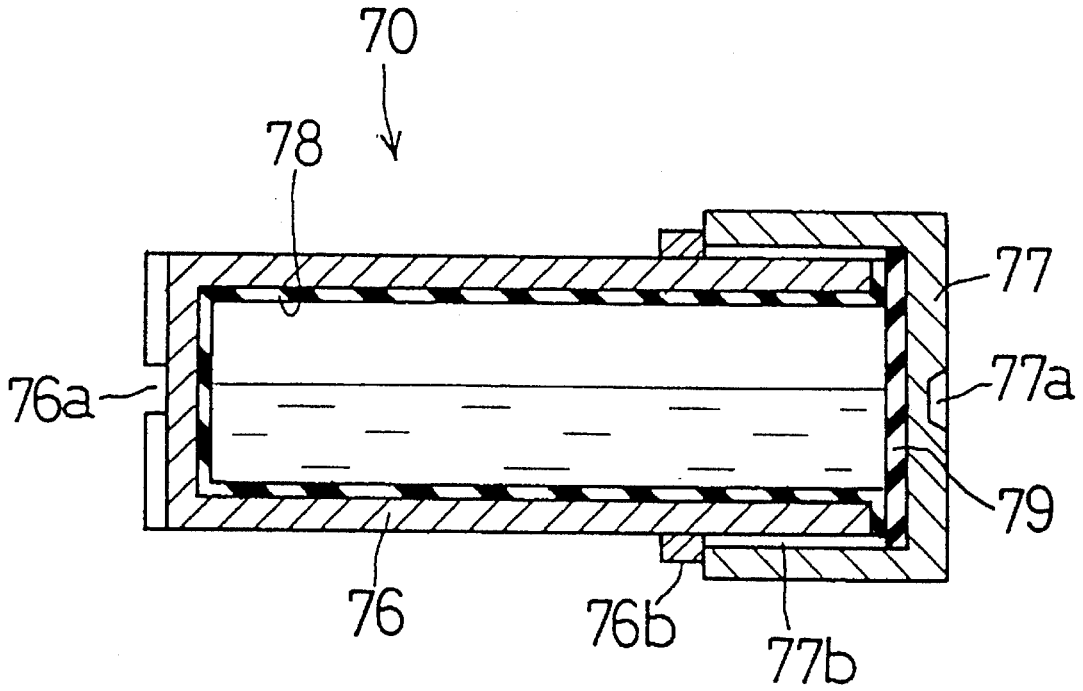

FIG. 20 is an axial cross sectional view of one barrel according to a third preferred embodiment of the present invention.

Figure 21:
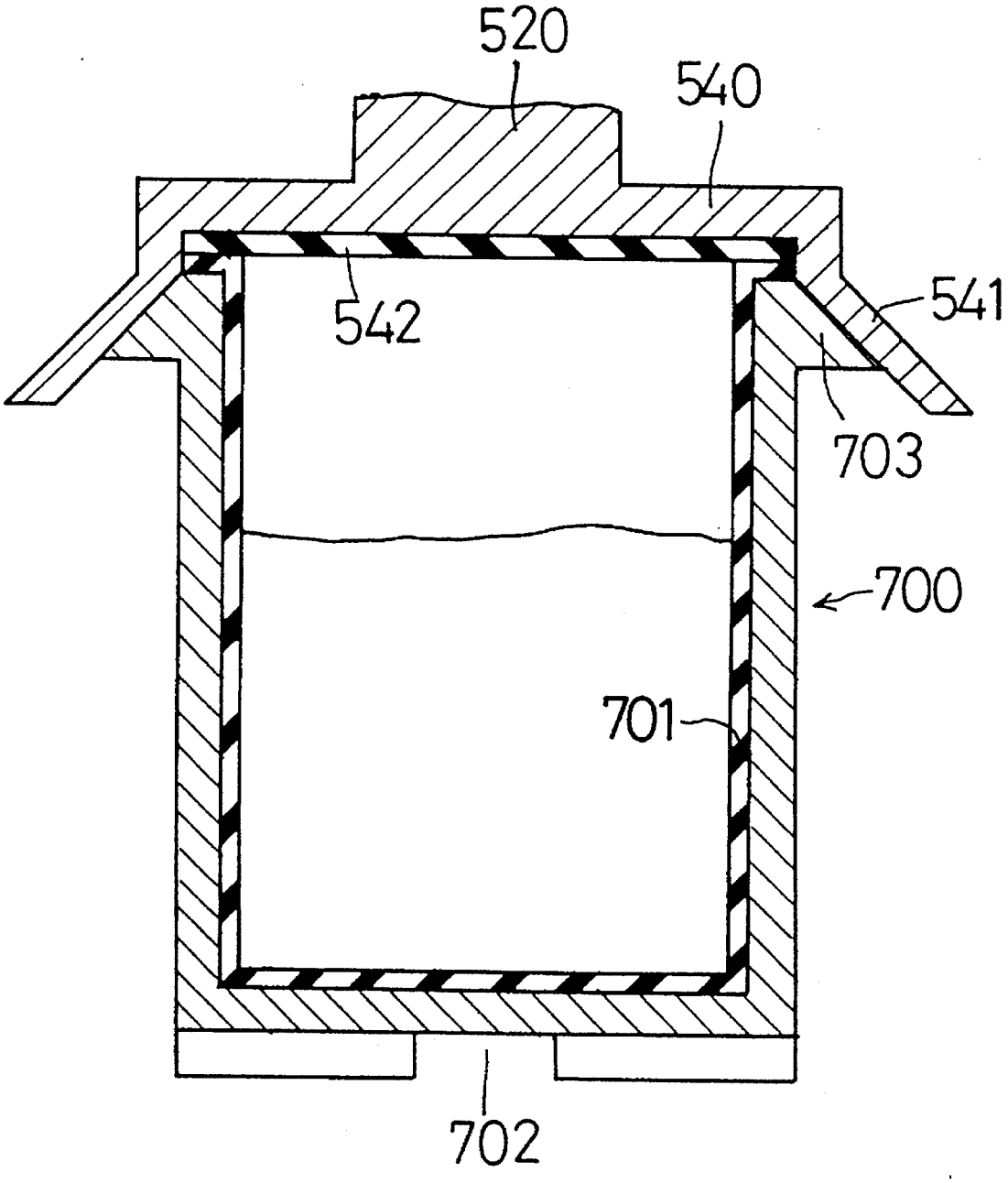

FIG. 21 is an axial cross sectional view of one barrel according to a fourth preferred embodiment of the present invention.

Figure 22:
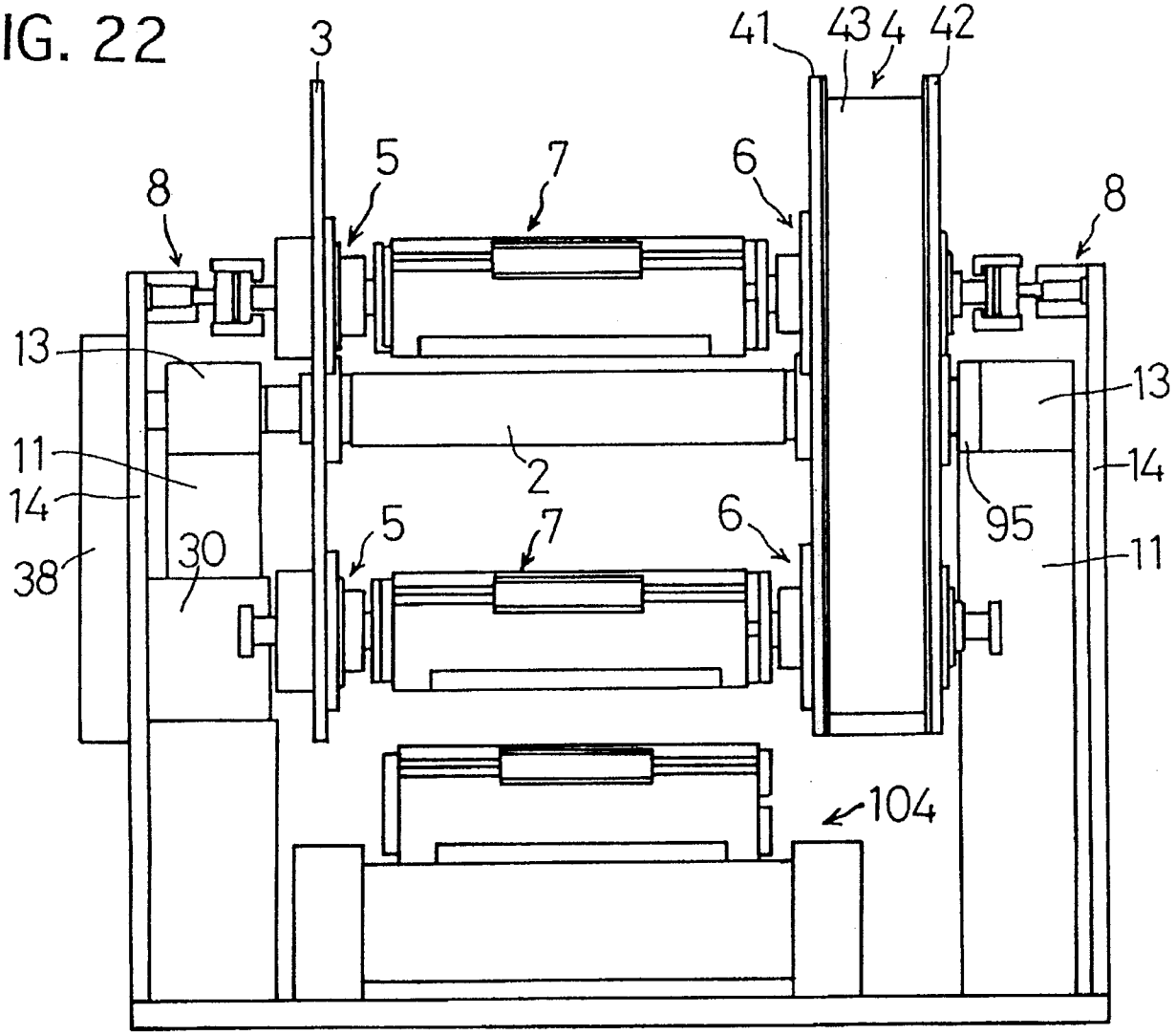

FIG. 22 is a front view of an apparatus according to a fifth preferred embodiment of the present invention.

Figure 23:
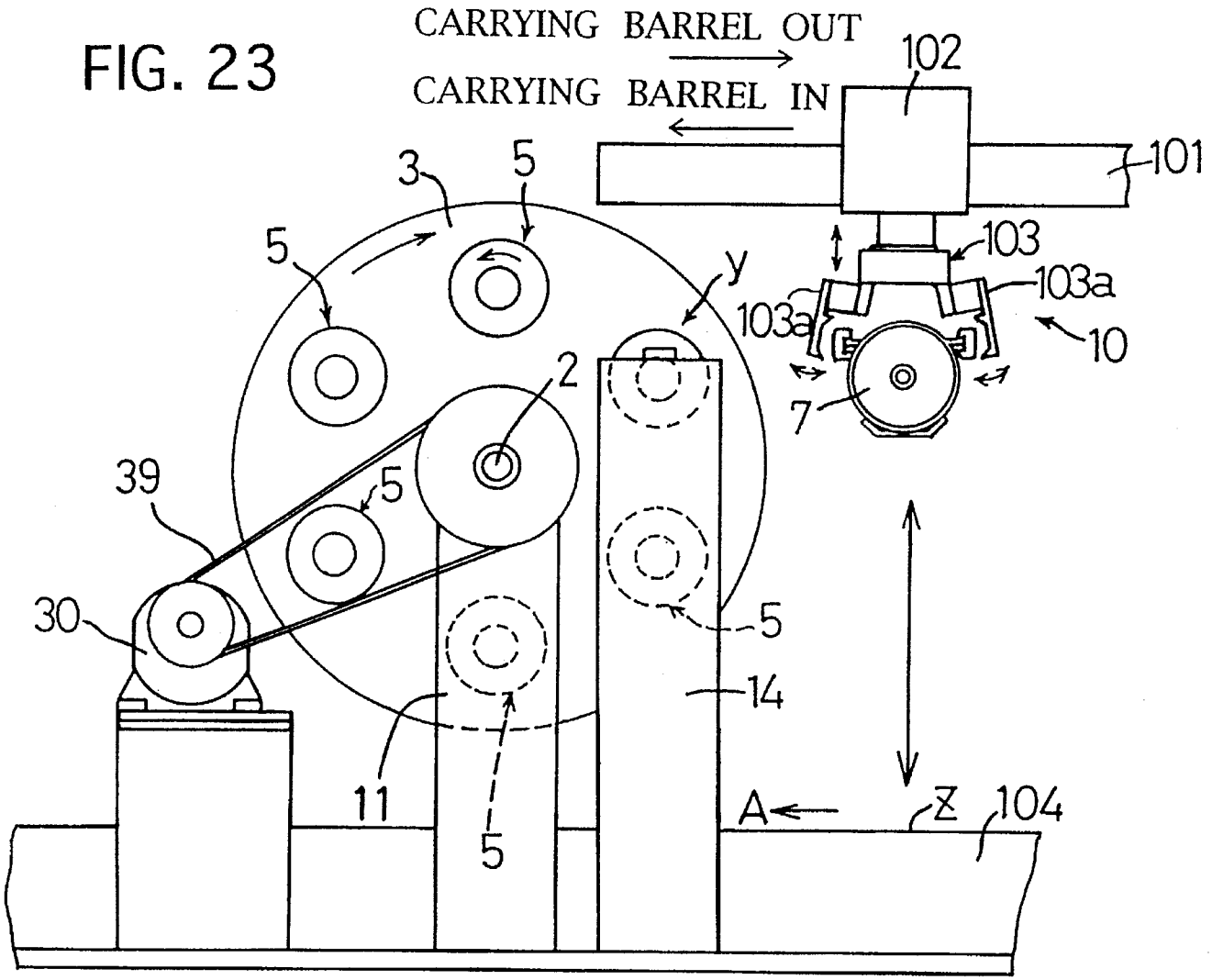

FIG. 23 is a side view of an apparatus according to the fifth preferred embodiment of the present invention.

DETAILED DESCRIPTION OF THE PREFERRED EMBODIMENTS

(The First Preferred Embodiment)

Now, a horizontal full automatic centrifugal fluidizing barrel processing apparatus according to a first preferred embodiment of the present invention will be described with reference to the drawings. FIG. 1 is a plan view of that apparatus, FIG. 2 is a front view of that apparatus, and FIG. 3 is a side view of that apparatus.

This apparatus is a horizontal full automatic centrifugal fluidizing barrel polishing apparatus, and a bearing stand 11 is provided on each of the right and left ends of a frame 1 in the cross-sectional center, and a bearing housing 13 fixed to each bearing stand 11 holds a revolutionary shaft 2.

A motor (a revolution driving source of the present invention) 30 is fixed to the frame 1. The motor 30 drives a revolutionary shaft 2 by way of a belt 39 provided in a belt cover 38. The belt cover 38 is omitted in FIG. 3.

A disk member 3 and a cylindrical member 4 are fixed to the revolutionary shaft 2 at a predetermined distance from each other. Six rotary pinching mechanisms 5 are rotatably provided on the disk member 3 at equal circumferential intervals around the revolutionary shaft 2. Six rotary pinching mechanisms 6 are rotatably provided on the cylindrical member 4 at equal intervals in the circumferential direction around the revolutionary shaft 2. Each axis of the rotary pinching mechanisms 5 is aligned with each axis of the rotary pinching mechanisms 6 and is in parallel with the revolutionary shaft 2.

The cylindrical member 4 comprises a disk 41 constituting an end surface on the barrel pinching side, i.e., on the left side in FIG. 1 and FIG. 2; a disk 42 constituting an end surface on the opposite side to the barrel pinching side, i.e., on the right side in FIG. 1 and FIG. 2, and a cylinder 43 having open ends and pinched by the disks 41 and 2. These parts are fastened together by bolts (not shown) and have an airtight cylindrical space constituting a planetary gear room S (see FIG. 5) on their inside.

The rotary pinching mechanisms 5 and 6 respectively pinch airtight long cylindrical barrels 7. The barrels 7 are revolved and rotated by the rotary pinching mechanisms 5 and 6, as mentioned later.

A thick plate-shaped strut 14 is vertically provided on the front part of each of the left and right ends of the frame and a hydraulic cylinder 8 for releasing the pinch of the barrels is provided to the strut 14. The hydraulic cylinder 8 together with the rotary pinching mechanisms 5 and 6 constitute the barrel pinching mechanism of the present invention.

The cylindrical member 4 having an airtight cylindrical shape with a short axis has on the inside a planetary gear mechanism (a planetary moving mechanism of the present invention) 9 driven by the revolutionary shaft 2 while being lubricated in an oil bath.

Now, this planetary gear mechanism 9 will be described with reference to FIGS. 4 to 6. FIG. 4 is a radial cross-sectional diagram of the cylindrical member 4. In FIG. 4, the cylindrical member 4 is shown by a circle of a large diameter.

A sun gear 91 is attached to the revolutionary shaft 2 in a manner to permit relative rotation, and fixed to the bearing stand 11 as shown in FIG. 1. In the cylindrical member 4, a gear train is supported which comprises three planetary gears 92 engaging with the sun gear 91, and six rotary gears 93 engaging with the planetary gears 92. The rotary gears 93 are respectively connected to rotary shafts 61 which will be described later. Therefore, when the cylindrical member 4 rotates with the revolutionary shaft 2, the planetary gears 92 and the rotary gears 93 revolve around the revolutionary shaft 2, and the rotary gears 93 are rotated by way of the planetary gears 92 engaging with the sun gear 91. Each rotary gear 93 is designed to have the tooth number at which one rotation is made during one revolution, and the barrels 7 revolve around the revolutionary shaft 2 with maintaining a stationary posture.

FIG. 5 is an enlarged view of an axial cross section of a center portion of the cylindrical member 4.

A boss 21 is fixed to the revolutionary shaft 2 and the disk 41 of the cylindrical member 4 is fastened to the boss 21 by bolts (not shown). Pins 92*a* are respectively fixed on the disk 41 at equal circumferential distances around the revolutionary shaft 2. Each pin 92*a* supports one planetary gear 92 by way of a pair of bearings 92*c* which are separated from each other by a sleeve 92*b*.

On the other hand, the sun gear 91 is supported by the revolutionary shaft 2 by way of a pair of bearings 91*c* which are separated from each other by sleeves 91*a* and 91*b*. The sun gear 91 engages with each planetary gear 92. A sleeve 94 having an outward flange is attached to the revolutionary shaft 2 on the right side of the sun gear 91, and can make relative rotation with respect to the revolutionary shaft 2 owing to a bearing 94*a*. The left end surface of the sleeve 94 is a flange and fastened to the right end surface of the sun gear 91 by bolts (not shown). The right end surface of the sleeve 94 is inserted in a bore 95*a* of a support plate 95 which is fixed to the bearing stand 13, and fixed by bolts (not shown) or the like. Therefore, the sun gear 91 is fixed to the bearing stand 11 by way of the sleeve 94 and the support plate 95. 94*b* designates a sleeve which separates a bearing 91*c* from a bearing 94*a*. The disk 42 of the cylindrical member 4 on the opposite side to the barrel pinching side is supported by the sleeve 94 by way of a boss 44 and a bearing 44*a*. 44*b* designates a mechanical seal.

FIG. 6 is an enlarged view of a cross section of the cylindrical member 4 around one rotary shaft 61 and one rotary pinching mechanism 6.

One rotary gear 93 which engages with one planetary gear 92 is attached to the rotary shaft 61, and the sleeve 93*a* prevents the rotary gear 93 from relative rotation with respect to the rotary shaft 61.

A boss 46 is fastened to the disk 41 of the cylindrical member 4 by bolts (not shown), and holds the rotary shaft 61 by way of bearings 6*a* and 6*b*. 6*c* designates a mechanical seal. A boss 47 is fastened to the disk 42 of the cylindrical member 4 by bolts (not shown), and holds the rotary shaft 61 by way of a bearing 6*d*. 6*e* designates a mechanical seal.

The rotary pinching mechanism 6 comprises a pinching shaft 62 which is held by the rotary shaft 61 by way of a metal bearing 6*f* in a manner to permit axial sliding, a connecting rod 66 which is slidably held by a counterbore 61*a* on the left end of the rotary shaft 61 and which is fastened to the left end of the pinching shaft 62 by a bolt 65, a spring which is wound around the pinching shaft 62 and installed in the counterbore 61*a* on the left end of the rotary shaft 61, a barrel support plate 64 fixed to the left end of the connecting rod 66, and a stop rod 67 which is fastened to the right end of the pinching shaft 62. Therefore, the barrel support plate 64 is held by the rotary shaft 61 by way of the pinching shaft 62 in a manner to permit axial sliding, and the barrel support plate 64 together with the rotary shaft 61 rotates on the rotary shaft 61 and revolves around the revolutionary shaft 2.

On the end surface of the barrel support plate 64 on the barrel supporting side, a cross-shaped projection 64*a* is formed in the radial direction from the axis. In this preferred embodiment, in order to prevent the pinching shaft 62 from relative rotation with respect to the rotary shaft 61, an axial guide groove and a guide projection (not shown) which slidably engages with the guide groove (not shown) are formed on the sliding surfaces of the rotary shaft 61 and the pinching shaft 62. Therefore, the barrel support plate 64 together with the rotary shaft 61 always keeps a constant posture. When the rotation and revolution is stopped, the cross-shaped projection 94*a* always is made to extend in a vertical direction and in a horizontal direction. Owing to this construction, when one barrel 7 which will be mentioned in detail later is set at a predetermined position and the barrel support plate 64 is axially moved to the barrel pinching side, a cross-shaped groove 74 of the barrel 7 which will be mentioned later smoothly engages with the cross-shaped projection 64*a*.

A base end of the spring 63 is fixed to the rotary shaft 61, and a fore end of the spring 63 urges the connecting rod 66 in the barrel pinching direction. This urging force also urges the stop rod 67 in the barrel pinching direction by way of the pinching shaft 62, and the left end surface of the stop rod 67 is closely contacted with the right end surface of the rotary shaft 61. Therefore, the barrel support plate 64 is prevented from moving further in the barrel pinching direction. The rotary shaft 61 is held by the disks 41 and 42 by way of bearings in order not to retreat in the opposite direction to the barrel pinching direction (in the right direction) by the reaction of the spring 63.

Owing to the pinching mechanism 6 mentioned in the above, the barrel support plate 64 is urged by the spring 63 in the barrel pinching direction to pinch the barrel 7, and the rotary gear 93 is driven by the planetary gear 92 to rotate and revolve the rotary shaft 61, the pinching shaft 62, and the barrel support plate 64.

On the other hand, the stop rod 67 comprises a left end portion 67*a* having a large diameter, a center portion 67*b* having a small diameter, and a right end portion 67*c* having a large diameter. When a hydraulic cylinder 8 which will be described in detail later moves the flange-shaped right end portion 67*c* of the stop rod 67 in the opposite direction to the barrel pinching direction (in the right direction), the barrel support plate 64 retreats against the urging force of the spring 63, and as a result, the pinching of the barrel 7 by the barrel support plate 64 is released.

FIG. 7 is an enlarged view of a cross section of the disk member 3 around one rotary pinching mechanism 5.

A boss 31 is fastened to the disk member 3 by bolts (not shown), and holds one rotary shaft 51 by way of a pair of bearings 31*a*. 31*b* and 31*c* designate spacers for separating the pair of bearings 31*a*. A cover plate 32 having a hole closes an opening of the boss 31 on the opposite side to the barrel pinching side, and is fixed to the boss 31.

The rotary pinching mechanism 5 comprises a pinching shaft 52 which is held by the the rotary shaft 51 by way of a metal bearing 51*a* in a manner to permit axial sliding, a spring 53 which is wound around the pinching shaft 52 and installed in a bore of the rotary shaft 51, a barrel support plate 54 fixed to the right end portion of the pinching shaft 52, a bolt 56 which is inserted in a counterbore 52*a* of the pinching shaft 52 and which is screwed on the pinching shaft 52 along the axis of the pinching shaft 52, a centering pin 55 which is slidably inserted in the counterbore 52*a* and which is slidably attached to the bolt 56, a centering spring 58 which is wound around the bolt 56 and installed in the counterbore 52*a* of the pinching shaft 52, and a stop rod 57 fastened to the left end portion of the pinching shaft 52.

A base end of the spring 53 is fixed to the rotary shaft 51, and a fore end of the spring 53 urges a stepped portion of the pinching shaft 52 in the barrel pinching direction. As a result, the pinching shaft 52 is always urged in the barrel pinching direction. However, since the stop rod 57 is fixed to the left end surface 51*b* of the rotary shaft 51, the pinching shaft 52 and the barrel support plate 54 are prevented from moving further in the barrel pinching direction.

The stop rod 57 comprises a right end portion 57*a* having a large diameter, a center portion 57*b* having a small diameter, and a left end portion 57*c* having a large diameter. When a hydraulic cylinder 8 which will be described later moves the flange-shaped left end portion 57*c* of the stop rod 57 in the opposite direction to the barrel pinching direction (i.e., in the left direction), the barrel support plate 54 retreats against the urging force of the spring 53, and as a result, the pinching of the barrel 7 by the barrel support plate 54 is released.

A base end of the centering spring 58 is fixed to a stepped surface in the counterbore 52*a* of the pinching shaft 52, and a fore end of the centering spring 58 urges the centering pin 55 in the barrel pinching direction. The urged centering pin 55 is fixed to a large-diameter head of the bolt 56, and accordingly, the centering pin 55 is inhibited from moving further in the barrel pinching direction.

Therefore, in pinching the barrel 7, the centering pin 55 is axially urged to be inserted in a centering cavity of the barrel 7 which will be mentioned later.

Owing to the rotary pinching mechanism 5 mentioned in the above, the barrel support plate 54 is urged by the spring 53 in the barrel pinching direction to pinch one barrel 7 securely. Further, since the centering pin 55 is allowed to retreat in the opposite direction to the barrel pinching direction by the centering spring 58, it is easy to align the axis of the rotary pinching mechanism 5 with that of the barrel 7 in pinching the barrel 7.

In this way, the barrel support plate 54 is urged by the spring 53 in the barrel pinching direction to pinch the barrel 7, and allowed to rotate and revolve together with the barrel 7. When the hydraulic cylinder 8 which will be described later moves the stop rod 57 in the opposite direction to the barrel pinching direction, the barrel support plate 54 retreats against the urging force of the spring 53, and the pinching of the barrel 7 by the barrel support plate 54 is released.

Now, the hydraulic cylinder 8 for releasing the pinching of the barrel will be described with reference to FIGS. 8 and 9. FIG. 8 is a plan view of the independent control hydraulic cylinder 8, and FIG. 9 is a front view of the hydraulic cylinder 8.

The hydraulic cylinder 8 comprises a cylinder 81 fixed to the strut 14, and a pair of guides 83 fixed to the strut 14 and disposed respectively in front of and behind the cylinder 81, a rod 82 which movably protrudes from the cylinder 81, a plate 84 fixed to a fore end of the rod 82, and a pair of pinching plates 85 which are respectively fixed to the upper and bottom surfaces of the plate 84 and which extend in the barrel pinching direction and horizontally in parallel with each other. Each end portion of the pair of the pinching plates 85 on the barrel pinching side has a claw 86 in a manner to protrude in a direction to face to each other. In FIGS. 8 and 9, the pair of pinching plates 85 of the hydraulic cylinder 8 can pinch the left end portion 57*c* (or the right end portion 67*c*) of the stop rod 57 (or 67) from the top and the bottom. When the rod 82 is retreated in the pinched state, the pair of pinching plates 85 move the left end portion 57*c* (or the right end portion 67*c*) of the stop rod 57 (or 67) in the opposite direction to the barrel pinching direction, and thereby the distance between the barrel support plates 54 and 56 is increased and the barrel 7 is released from the barrel support plates 54 and 64.

It must be noted that when the pair of pinching plates 85 are not moved in the opposite direction to the barrel pinching direction, the stop rod 56 or 67 is movable in the circumferential direction of the revolutionary shaft 2 between the pair of pinching plates 85. Therefore, the pair of pinching plates 85 do not inhibit the stop rod 57 or 67 from revolving around the revolutionary shaft 2. In releasing one barrel 7 from the rotary pinching mechanisms 5 and 6, the revolutionary shaft 2 is stopped at a predetermined stop phase, and the stop rods 57 and 67 fastened respectively to the pinching shafts 52 and 62 are put adjacent to the pinching plates 85 and then the hydraulic cylinder 8 is actuated. 83*a* designates a spring for returning the rod 82 in the original position.

Now, one barrel 7 will be described with reference to FIGS. 10 and 11. FIG. 10 is a front elevation seen from the front direction of FIG. 2. FIG. 11 is a cross section taken on the line A—A in FIG. 10.

The barrel 7 comprises a main cylindrical portion 71, a lid portion 72 for closing an opening 70 of the main cylindrical portion 71, stop disks (engaging centering portions of the present invention) 73 and 74 which will be mentioned later, and four clamp members 75, and a stand 76. The main cylindrical portion 71 and the lid portion 72 are shaped of a cylinder having closed ends which is cut at a predetermined distance from the axis in a parallel direction to the axis. The main cylindrical portion 71 and the lid portion 72 in a sealed state form an airtight cylindrical space on the inside.

The main cylindrical portion 71 has longitudinal dovetail flanges 71*a* which extend from the both longitudinal edges of the opening 70 in horizontal directions in FIG. 11, i.e., in the horizontal direction in FIGS. 1 and 2. Similarly, the lid portion 72 has dovetail flanges 72*a* which extend from the both longitudinal opening edges in horizontal directions in FIG. 11 so as to face the dovetail flanges 71*a*. Further, rubber lining layers 77 and 78 adhere to inner surfaces of the main cylindrical portion 71 and the lid portion 72 including inner surfaces of the dovetail flanges 71*a* and 72*a*. In FIG. 11, the rubber linings 77 and 78 are closely contacted with each other by being pinched by the dovetail flanges 71*a* and 72*a*. Further, lips 78*a* are formed to protrude from the rubber lining 78 to surround the opening 70 doubly in order to seal the opening 70.

The dovetail flanges 71*a* and 72*a* respectively have a larger thickness as they go away from the opening 70. The upper surface of the dovetail flange 71*a* has the opposite inclination to that of the lower surface of the dovetail flange 72*a* with respect to the opening 70.

Each of the four clamp members 75 clamps the dovetail flanges 71*a* and 72*a* in order to seal the inner space of one barrel 7, and has a great length and a cross section of a rectangle without one side as shown in FIG. 11. Each clamp member 75 has a long dovetail groove 75*a* which extends in the longitudinal direction, and the dovetail flanges 71*a* and 72*a* and the rubber lining layers 77 and 78 are inserted in the long groove 75*a*. Of course, side surfaces of the long groove 75*a* have equal inclination to those of the upper surface of the dovetail flange 71*a* and the lower surface of the dovetail flange 72*a*. As a result, the clamp member 75 is prevented from slipped off in the horizontal direction, and at the same time, when the clamp member 75 is moved in the direction to be slipped off, the lid portion 72 is pressed onto the main cylindrical portion 71. Therefore, the lips 78*a* of the rubber lining layer 78 are compressed and the sealing effect is enhanced by that reaction.

Each clamp member 75 is attached by forcing the dovetail flanges 71*a* and 72*a* into the clamp member 75 from the longitudinal ends. The stand 76 is to determine the posture of the barrel 7 when placed on floors or a conveyor, and fixed to the lower surface of the main cylindrical portion 71.

The stop disks 73 and 74 are respectively fastened to the both end surfaces of the main cylindrical portion 71 by bolts (not shown) so as to align the axes with each other. The outer surface center of the stop disk 73 has a conical centering concave 73*a*, while the outer surface of the stop disk 74 has the cross-shaped groove 74*a* which passes the center of the stop disk 74. The centering concave 73*a* can receive the centering pin 55 of the rotary pinching mechanism 5, while the cross-shaped groove 74*a* can receive the cross-shaped projection 64*a* of the rotary pinching mechanism 6 as shown in FIG. 6.

In another preferred embodiment, the rotation of the barrel support plate 64 may make the engagement of the cross-shaped projection 64*a* of the barrel support plate 64 with the cross-shaped groove 74*a* of the stop disk 74 of the barrel 7.

In this preferred embodiment, the engaging centering portions of the present invention are constituted by the stop disks 73 and 74. However, the shape of the engaging centering portions can be modified, as long as the engaging centering portions are aligned with the axis of the barrel 7 and the barrel 7 is pinched and rotated.

Each barrel 7 described in the above has the following characteristics.

First, the dovetail flanges 71 and 72*a* and the rubber lining layers 77 and 78 are inserted into the longitudinal groove 75*a* of the clamp member 75, by sliding the clamp member 75 from one end of the dovetail flanges 71*a* and 72*a* in the longitudinal direction. Therefore, the clamping is easily completed only by pushing the lid portion 72 against the main cylindrical portion 71 slightly.

Secondly, the rubber lining layers 77 and 78 for protecting the inner surfaces of the main cylindrical portion 71 and the lid portion 72 from abrasion in polishing also cover the dovetail flanges 71*a* and 72*a*, thereby rendering elastic reaction force in clamping. Therefore, it is possible to omit any special elastic member for rendering the elastic reaction force in clamping.

Thirdly, since both the dovetail flanges 71*a* and 72*a* are formed to have a larger thickness as they go away from the opening of the main cylindrical portion 71, the clamp member 75 is inhibited from being slipped off in the direction to go away from this opening. Particularly, although during the rotation of the barrel 7, centrifugal force urges the clamp member 75 in the direction to go away from the opening, this urging force acts on the clamp member 75 to urge the both dovetail flanges 71*a* and 72*a* in the direction to contact each other closely, as shown by the cross sectional shape in FIG. 11. Therefore, the sealing effect is enhanced in spite of the movement of the clamp member 75.

Now, the barrel handling apparatus 10 will be described with reference to FIGS. 3, 12, and 13.

The barrel handling apparatus 10 comprises a mobile suspension portion 102 which can move along a rail 101 extending in a horizontal direction perpendicular to the axis of the revolutionary shaft 2, a barrel holding portion 103 which hangs down from the mobile suspension portion 102 in a manner to permit horizontal movement, and a conveyor 104. The movable suspension portion 102 and the barrel holding portion 103 are actuated by electric powder supplied from a power supply mechanism not shown.

The barrel holding portion 103 has a pair of arms 103*a*, and fore ends of the arms 103 can hold the clamp members 75 of the barrel 7. FIG. 12 shows a state in which the barrel 7 is held by the arms 103*a*, and FIG. 13 shows a state in which the barrel 7 is released from the holding by the arms 103*a*. The conveyor 104 moved intermittently extends in a horizontal direction which is perpendicular to the paper in FIG. 3. The conveyor 104 feeds an untreated barrel 7 from the upstream and carries the treated barrel 7 which has been received from the barrel holding portion 103 out to the downstream.

Hereinafter, the operation of this horizontal full automatic centrifugal barrel polishing apparatus will be described.

Suppose that the polishing treatment is finished.

First, a motor 30 is stopped to stop the revolution and rotation of the barrel 7. When the motor 30 is to be stopped, the motor 30 is switched to a low speed rotation, and a position detective sensor (not shown) which is provided on the bearing stand 11 or the strut 14 detects whether the turning angle of the disk member 3 is a predetermined stop angle, and then the disk member 3 is always stopped at a predetermined stop angle. In this stop state, one barrel 7 to be released from the rotary pinching mechanism 5 and 6 (hereinafter referred to an object barrel 7) is stopped at an upper right position y in FIG. 3.

Secondly, the mobile suspension portion 102 of the barrel handling apparatus 10 is moved just above the object barrel 7, and then the barrel handling portion 103 of the barrel handling apparatus 10 holds the object barrel 7. Then, the hydraulic cylinders 8 which are respectively adjacent to the outer sides of the rotary pinching mechanisms 5 and 6 are actuated to release the pinching of the object barrel 7. Then, the mobile suspension portion 102 is moved just above the conveyor 104. Then the barrel holding portion 103 descends and loads the object barrel 7 on the conveyor 104. After that, the conveyor 104 is moved for a predetermined distance and stopped at the position where an untreated barrel 7 on the conveyor 104 comes just under the barrel holding portion 103. Then, after the barrel holding portion 103 holds the untreated barrel 7, the barrel holding portion 103 ascends and the mobile suspension portion 102 moves the untreated barrel 7 to the upper right position y. Then, the hydraulic cylinders 8 release the urging of the rotary pinching mechanisms 5 and 6 in the opposite direction to the barrel pinching direction, and the untreated barrel 7 is pinched by the barrel support plates 64 and 54. After that, the the barrel holding portion 103 releases the holding of the untreated barrel 7, and ascends and retreats above the conveyor 104. Then, the motor 30 is driven to turn the revolutionary shaft 2 for a predetermined angle and the next treated barrel 7 is changed with untreated one. This operation is repeated until all the barrels 7 are replaced with untreated ones 7. Then the untreated barrels 7 are revolved around the revolutionary shaft 2 and rotated on the rotary shafts 51 and 61, thereby polishing workpieces in the untreated barrels 7.

As mentioned in the above, since the rotary pinching mechanisms 5 and 6 and the hydraulic cylinders 8 in this preferred embodiment constitute the barrel pinching mechanism of the present invention, the component parts for pinching and releasing the barrels, in particular, the mechanisms for revolution and rotation can be simplified in construction and reduced in weight. Accordingly, the reliability and durability of the apparatus are improved, and the size of the apparatus is decreased owing to the decrease of the mass to be revolved.

In addition, since the axis of each barrel 7 is aligned by the centering pin 55, the axis of each barrel is prevented from slanting and each barrel is inhibited from being dropped off during the rotation and the revolution.

Further, since the stop rods 57 and 67 revolve and rotate with the left end portion 57*c* and the right end portion 67*c* of the stop rods 57*c* and 67*c* engaged with the claws 86 of the rods 82 of the hydraulic cylinders 8, there is no need to revolve or rotate the hydraulic cylinders 8. Therefore, the mass to be revolved is reduced and the size of the apparatus can be decreased.

The stop of the revolutionary shaft 2 at a predetermined stop phase requires only to detect the turning angle of the disk member 3 by a limit switch, a rotary encoder or the like and control the motor 30. Since this mechanism is well known to the skilled in the art, detailed description of the mechanism is omitted here.

(The Second Preferred Embodiment)

Now, a preferred embodiment of a vertical full automatic centrifugal fluidizing barrel processing apparatus according to the present invention will be described.

FIG. 14 shows a plan view of this apparatus, and FIG. 15 shows a front elevation of this apparatus.

This apparatus is a vertical full automatic centrifugal fluidizing barrel polishing apparatus. A strut 1*b* is vertically provided at each of the four corners of a base 1*a*, and each top of the struts 1*b* is fixed to a roof 1*c*. The base 1*a*, the struts 1*b* and the roof 1*c* constitute a frame 1 of the present invention. Bearing housings 13 are fixed to an upper surface center of the base 1*a* and a lower surface center of the roof 1*c*, respectively. A radial bearing (not shown) in each of the bearing housings 13 holds a revolutionary shaft 2 vertically. Further, a thrust bearing (not shown) is stored in the center portion of the base 1*a*, and rotatably holds a lower end of the revolutionary shaft 2.

A motor 30 (a revolution driving source of the present invention) is fixed to an upper surface of the roof 1*c*, and a driving shaft of this motor is directly connected to the revolutionary shaft.

A disk member 3 and a cylindrical member 4 are fixed to the revolutionary shaft 2 at a predetermined distance from each other. Six rotary pinching mechanisms 5 are rotatably provided at equal circumferential distances on the disk member 3 around the revolutionary shaft 2. Similarly, six rotary pinching mechanisms 6 are rotatably provided at equal circumferential distances on the cylindrical member 4 around the revolutionary shaft 2. Each axis of the rotary pinching mechanisms 5 is aligned with each axis of the rotary pinching mechanisms 6, and these axes are in parallel with the revolutionary shaft 2. The rotary pinching mechanisms 5 and 6 respectively pinch sealed long cylindrical barrels 7, and the barrels 7 are revolved and rotated by the rotary pinching mechanisms 5 and 6 as mentioned later.

The basic constitution of the disk member 3, the cylindrical member 4, the rotary pinching mechanisms 5 and 6, and the hydraulic cylinders 8 is the same as in the first preferred embodiment except the following constitution.

As shown in FIG. 14, the hydraulic cylinders 8 are provided on the base 1*a* and the roof 1*c*. As shown in FIG. 14, the revolutionary shaft 2 is held by the thrust bearing stored in the base 1*a*. As shown in FIG. 16, each pin 92*a* is covered with a cap 92*d* by a screw not shown. As shown in FIG. 17, a sun gear 91 is held by the base 1*a* by way of a sleeve 94, a support plate 95, and the bearing housing 13. As shown in FIG. 17, each rotary shaft 61 is held by the cylindrical member 4 by way of a sleeve 93*a*, a thrust bearing 6*g*, and a boss 48. As shown in FIG. 18, a bearing stopper 59 is screwed on each rotary shaft Now, one barrel 7 used in this preferred embodiment will be described with reference to FIG. 19. FIG. 21 shows an axial cross section of the barrel 7.

The barrel 7 comprises a main cylindrical portion 71 shaped of a cylinder with a great depth, and a lid portion 72 shaped of a cylinder with a shallow depth and to be attached on the main cylindrical portion 71 in order to close the opening of the main cylindrical portion 71. The outer surface of the bottom of the main cylindrical portion 71 has a cross-shaped groove 71*a*, and the center of the outer surface of the lid portion 72 has a centering hole 72*a*. The centering hole 72*a* of the lid portion 72 can be engaged with the centering pin 55 of the rotary pinching mechanism 5, while the cross-shaped groove 71*a* of the main cylindrical portion 71 can be engaged with a cross-shaped projection 64*a* of the barrel support plate 64 of the rotary pinching mechanism 6 (see FIG. 5). The inner surface of the bottom of the lid portion 72 has a circular concave 71*c* into which the top portion of the cylindrical wall of the main cylindrical portion 71 can be inserted, and an O-ring 73 is provided on the top portion of the cylindrical wall of the main cylindrical portion 71. Further, four straight grooves 72*b* are formed on the inner circumferential surface of the lid portion 72 in axial directions in a manner to be separated from each other at an angle of 90°, and rotation preventing pins 73 are formed on the outer circumferential surface of the main cylindrical portion 71 so as to be engaged with those straight grooves 72*b*. Therefore, the main cylindrical portion 71 rotates the lid portion 72 by being driven by the barrel support plate 64. The O-ring 73 seals the inner space of the barrel 7 by being pinched by the barrel support plates 54 and 64.

In this preferred embodiment, the barrel support plate 64 keeps a constant posture during the rotation and the revolution, and the cross-shaped projection 64*a* of the barrel support plate 64 always extends in parallel with the side lines of the base 1*a*. Therefore, the cross-shaped groove 71*a* of the barrel 7 is automatically engaged with the cross-shaped projection 64*a* of the barrel support plate 64 by setting the barrel 7 at the predetermined posture and moving the barrel support plate 64 axially to the barrel pinching side. As a modification, a cross-shaped groove 71*a* of the barrel 7 may be engaged with a cross-shaped projection 64*a* of the barrel support plate 64 by rotating the barrel support plate 64.

The barrel 7 described in the above has a simple constitution in which the main cylindrical portion 71 having a barrel shape is only covered with the lid portion 72, and it is easy to attach and remove the lid portion 72. However, the apparatus and its peripheries do not get dirty in setting the barrel 7 to the apparatus and removing the barrel 7 from the apparatus.

Now, the barrel handling apparatus 10 will be described with reference to FIG. 15.

The barrel handling apparatus 10 comprises a handling robot 100 and a conveyor 200. The handling robot 100 comprises a base 101 fixed to the floor, a cylindrical drum 102 held on the base 101 in a manner to permit horizontal rotation on an axis m, an arm 103 projecting from the circumferential surface of the drum 102 so as to reciprocate in a radial direction, and a pair of hands 104 fixed to the fore end of the arm 103 and movable in the directions perpendicular to that reciprocating direction and to go away from each other. Since the operation of each part of the handling robot 100 is well known to the skilled in the art, the description is omitted here.

The conveyor 200 moved intermittently feeds an untreated barrels 7 from the upstream and carries a treated barrel 7 out to the downstream which has been received from the barrel holding portion 103.

Now, the operation of this vertical full automatic centrifugal fluidizing barrel polishing apparatus will be described.

Suppose that a polishing step is finished.

First, the motor 30 is to be stopped to stop the rotation and revolution of the barrels 7. In stopping the motor 30, the motor 30 is switched to a low speed rotation, and a position detective sensor (not shown) which is fixed on the support plate (not shown) hanging from the roof 1*c* detects whether the turning angle of the disk member 3 is a predetermined stop angle, and accordingly the motor 30 always stops the disk member 3 at the stop angle. In this stop position, a barrel 7 to be released from the rotary pinching mechanisms 5 and 6 (hereinafter referred to as an object barrel) exists in the most adjacency to the handling robot 100.

Secondly, the arm 103 of the handling robot 100 is extended from the position shown in FIG. 2 to the limit toward the object barrel. At this time, the distance between the both hands 104 is increased and the hands 104 come to the both sides of the object barrel 7. Then, the distance between the both hands 104 is decreased and the hands 104 hold the object barrel 7. Next, the hydraulic cylinders 8 (see FIG. 14) are actuated to release the pinching of the object barrel 7 by the rotary pinching mechanisms 5 and 6. Then the arm 103 retreats to the limit, i.e., the position shown in FIG. 15. After that, the drum 102 turns at an angle of 180° and then the arm 103 is extended to the limit. As a result, the outer bottom surface of the object barrel 7 positions above the carrier surface of the conveyor 200 by about 1 to 2 cm. Then, the distance between the both hands 104 is increased and the object barrel 7 is placed on the carrier surface of the conveyor 200. Next, the arm 103 retreats to the limit. Then, the conveyor 200 moves for a predetermined distance and the object barrel 7 is removed, and then an untreated barrel is fed. Next, the arm 103 is extended to the limit and the hands 104 hold the untreated barrel. Then, the arm 103 retreats to the limit and the drum 102 turns at an angle of 180°, and then the arm 103 is extended to the limit. As a result, the untreated barrel is set between the rotary pinching mechanisms 5 and 6. Then the distance between the both hands 104 is increased to release the holding of the untreated barrel by the hands 104. Then the hands 104 retreat to the limit.

In this way, one treated barrel (one object barrel 7) is replaced with one untreated barrel. After this, the revolutionary shaft 2 is turned at an angle of 60° and the operation of replacing a treated barrel with an untreated barrel is repeated for five times so that all the treated barrels 7 are replaced with untreated barrels. Then the motor 30 is driven to polish workpieces in the barrels 7.

Since there is no fear that contents escape from the barrels 7, the operating speed of the above handling robot 100 and the travel speed of the conveyor 200 can be remarkably increased. Accordingly, the processing time of the vertical full automatic centrifugal fluidizing barrel processing apparatus can be improved over the conventional one, and the environment around this apparatus can be kept clean.

The transfer of the barrels 7 between the apparatus and the outside is conduced by only one handling robot 100 in the above preferred embodiment, but a plurality of handling robots may be used and a handling robot may be used for the purpose of carrying in or carrying out only.

(The Third Preferred Embodiment)

Now, a modification of the barrels 7 will be described with reference to FIG. 20. FIG. 20 shows an axial cross section of a barrel 70.

Each barrel 70 comprises a main cylindrical portion 76 formed of a cylinder with a long axis and a lid portion 77 which is formed of a cylinder with a short axis and functions to close an opening of the main cylindrical portion 76, and rubber lining layers 78 and 79 which adhere to the inner surfaces of the main cylindrical portion 76 and the lid portion 77. The outer surface of the bottom of the main cylindrical portion 76 has a cross-shaped groove 76*a*, while the center of the outer surface of the lid portion 72 has a centering concave 77*a*. The cross-shaped groove 76*a* can be engaged with the cross-shaped projection 64*a* of the barrel support plate 64 of the rotary pinching mechanism 6. The centering concave 77*a* can receive the centering pin 55 of the rotary pinching mechanism 5.

Further, a female screwed surface 77*b* is provided on the inner circumference of the lid portion 77, and a male screwed surface is provided on the outer circumference of the main cylindrical portion 76. Thereby, the lid portion 77 is screwed on the main cylindrical portion 76. This screwing achieves elastic deformation of the contact surfaces of the rubber lining layers 78 and 79, thereby sealing the barrel 70.

A stopper ring 76*b* is fixed on the outer circumferential surface of the main cylindrical portion 76, in order to inhibit the rubber lining layer 78 from being compressed beyond necessity by turning the lid portion 77 excessively.

Since the lid portion 77 is screwed on the main cylindrical portion 76, the posture change of the barrel 7 does not cause the contents to be escaped to the outside of the barrel 7, even when the lid portion 77 is not pressed against the main cylindrical portion 76 by the barrel pinching mechanisms 5 and 6. This construction can be applied not only to a vertical full automatic centrifugal fluidizing barrel processing apparatus but also to a horizontal full automatic centrifugal fluidizing barrel processing apparatus.

Preferably, the thread is cut out in the direction to urge the lid portion 77 to be screwed into the main cylindrical portion 76, in rotating the barrel 70.

(The Fourth Preferred Embodiment)

Further, another modification of the barrels 7 will be described with reference to FIG. 21. FIG. 21 shows an axial cross section of a barrel 700.

In this preferred embodiment, a barrel support plate 540 is fixed to a pinching shaft 520. The barrel support plate 540 has the same construction as that of the barrel support plate 54 of the second preferred embodiment shown in FIG. 17, except that the centering pin 5 is omitted and a skirt portion 541 having a truncated cone shape extends from the outer periphery of the barrel support plate 540 in the barrel pinching direction. The skirt portion 541 constitutes a lid portion of the barrel 700. 542 designates a rubber lining layer provided on the barrel support plate 540.

The barrel 700 is shaped of a cylinder with a great depth, and the inner surface of the barrel 700 is covered with a rubber lining layer 701. A cross-shaped groove 702 is formed on the outer surface of the bottom of the barrel 700, and can be engaged with the cross-shaped projection 64*a* of the barrel support plate 64 of the rotary pinching mechanism 6. Further, an annular flange 703 is provided at the top portion of the circumferential wall of the barrel 700 in a manner to contact the skirt portion 541 closely by all the circumference.

This construction allows the barrel support plate 540 to close the opening of the barrel 700 at the time of pinching the barrel 700 by the barrel pinching mechanisms 5 and 6. Further, the contact surfaces of the skirt portion 541 and the annular flange portion 703 each having a truncated cone shape are effective in aligning the axis of the barrel support plate 540 with that of the barrel 700.

The contact surfaces of the rubber lining layers 542 and 701 are elastically compressed to seal the inner space by being pinched by the barrel pinching mechanisms 5 and 6.

(The Fifth Preferred Embodiment)

A fifth preferred embodiment will be described with reference to FIGS. 22 and 23. The arrangement of the barrel carrying conveyor 104 of the first preferred embodiment is modified in this preferred embodiment. FIG. 22 is a front elevation of the apparatus, and FIG. 23 is a side elevation of the apparatus.

A barrel handling apparatus 10 according to this preferred embodiment of the present invention comprises a mobile suspension portion 102 which can move along a rail 101 extended in a horizontal direction perpendicular to the axial direction of the rotary shaft 2, a barrel holding portion 103 which hangs from the mobile suspension portion 102 in a manner to permit vertical movement, and a barrel carrying conveyor 104. The barrel carrying conveyor 104 extends in a horizontal direction perpendicular to the axial direction of the revolutionary shaft 2.

The barrel holding portion 103 has a pair of arms 103*a*, and fore ends of the arms 103*a* can hold the clamp members 75 of one barrel 7. FIG. 12 shows the barrel 7 held by the arms 103*a*, and FIG. 13 shows the barrel 7 released from the holding by the arms 103*a*.

Now, the operation of this horizontal full automatic centrifugal fluidizing barrel polishing apparatus will be described.

Suppose that a polishing treatment is finished.

First, the motor 30 is to be stopped to stop the rotation and revolution of the treated barrels 7. When the motor 30 is to be stopped, the motor 30 is switched to a low speed rotation, and a position detecting sensor (not shown) provided on a strut 14 detects whether the turning angle of the disk member 3 is a predetermined stop angle and always stops the disk member 3 at the predetermined stop angle. In this stop state, a barrel 7 to be released from the rotary pinching mechanisms 5 and 6 (hereinafter referred to an object barrel) is stopped at an upper right position y in FIG. 23.

Secondly, the mobile suspension portion 102 of the barrel handling apparatus 10 moves Just above the object barrel 7 placed at the upper right position y, and the barrel holding portion 103 hanging from the mobile suspension portion 102 holds the object barrel 7. Then the hydraulic cylinders 8 adjoined to the outer sides of the rotary pinching mechanisms 5 and 6 which pinch the object barrel 7 are actuated to release the object barrel 7 from being pinched by the rotary pinching mechanisms 5 and 6. Then the mobile suspension portion 102 moves in the right direction in FIG. 23 just above a predetermined handling position z on the conveyor 104, and then the barrel handling portion 103 descends so that the object barrel 7 is placed at the handling position z on the conveyor 104.

Next, after the barrel holding portion 103 ascends for a predetermined distance, the conveyor 104 moves the loaded barrel 7 in a downstream direction A for a predetermined distance which will be described later, thereby moving the above object barrel 7 in the downstream direction, and at the same time, carrying in a new untreated barrel. (not shown) just under the barrel holding portion 103. It must be noted that an untreated barrel (not shown) is loaded on the conveyor 104 at every predetermined distance by a loading robot (not shown) and that each untreated barrel is loaded in a manner that the axis of each untreated barrel is perpendicular to the moving direction of the conveyor 104. Each untreated barrel on the conveyor 104 is carried in at the handling position z, for example, as follows. A non-contact position sensor detects whether an untreated barrel reaches the handling position z or a predetermined position just before the handling position z, and stops the conveyor 104 accordingly.

Next, after the barrel holding portion 103 descends and holds the untreated barrel 7, the barrel holding portion 103 ascends and the mobile suspension portion 102 moves the untreated barrel 7 to the upper right position y in FIG. 23. Then, the hydraulic cylinders 8 release the rotary pinching mechanisms 5 and 6 from urging in the opposite directions to the barrel pinching directions, whereby the untreated barrel 7 is pinched by the barrel support plates 64 and 54. Then, the barrel holding portion 103 releases the holding of the untreated barrel 7 and ascends for the predetermined distance, and the mobile suspension portion 102 moves above the handling position z. After that, the motor 30 is driven to turn the revolutionary shaft 2 at a predetermined angle and the replacement of a treated barrel 7 with a new untreated barrel is repeated. After all the replacement is finished, the barrels 7 are rotated and revolved to polish workpieces in the barrels 7.

In this preferred embodiment, since the working space of the processing apparatus and the handling robot 100 is secured above the barrel carrying conveyor, the required space is drastically decreased. This is a remarkable advantage in practical use.

Obviously, many modifications and variations of the present invention are possible in the light of the above teachings. It is therefore to be understood that within the scope of the appended claims, the invention may be practiced otherwise than as specifically described.

What is claimed is:

1. An automatic centrifugal fluidizing barrel processing apparatus, comprising:

a revolutionary shaft having a pair of disk members, horizontally held by a frame, and connected to a revolution driving source;

a plurality of pairs of rotary shafts which are rotatably held by said disk members and positioned on axes parallel to said revolutionary shaft and dividing a periphery of said revolutionary shaft equally;

a planetary moving mechanism which moves in conjunction with said revolutionary shaft and rotates said rotary shafts;

a plurality of airtight cylindrical barrels each having an engaging centering portion on both ends thereof and being capable of containing workpieces and polishing materials;

a barrel pinching mechanism which detachably pinches said barrels by moving, in the longitudinal direction, pinching shafts which are installed in said pairs of rotary shafts in a manner to permit axial sliding, and engaging said pinching shafts with said engaging centering portions;

a barrel handling mechanism which separately handles to carry out a treated barrel released at a predetermined stop phase of said disk members and to carry in an untreated barrel to be installed.

2. An automatic centrifugal fluidizing barrel processing apparatus according to claim 1, wherein each of said barrels is divided into a main cylindrical portion and a lid portion by an opening provided in parallel with a cylinder axis, and dovetail flanges which closely contact each other extend at said opening and a contact surface of at least one of said dovetail flanges is covered with an elastic sealing layer, and said dovetail flanges are pinched together by a clamp member having a dovetail groove which corresponds to said dovetail flanges.

3. An automatic centrifugal fluidizing barrel processing apparatus according to claim 2, wherein said elastic sealing layer is formed integrally with a rubber lining layer covering an inner surface of at least one of said main cylindrical portion and said lid portion.

4. An automatic centrifugal fluidizing barrel processing apparatus according to claim 1, wherein said planetary moving mechanism comprises a sun gear which is formed in at least one of said disk members, attached to said revolutionary shaft in an airtight gear room lubricated in an oil bath in a manner to permit relative rotation, and fixed to said frame; a coupling ring which is attached to said revolutionary shaft in a manner to permit relative rotation, which couples said frame with said sun gear, and which holds an end surface of said at least one of said disk members on the opposite side to the barrel pinching side so as to permit relative rotation; and rotary gears each attached to an outer circumference of each of said rotary shafts in said gear room in a manner to inhibit relative rotation; and planetary gears which engage with said sun gear and said rotary gears in said gear room.

5. An automatic centrifugal fluidizing barrel processing apparatus according to claim 1, wherein said ends of said pinching shafts on the opposite side to the barrel pinching side each have a flange extending in a radial direction of said revolutionary shaft, and a fore end of a rod of said pinch releasing actuator has a claw through which said flange can move in the circumferential direction of said revolutionary shaft and which can withdraw said flange in the opposite direction to the barrel pinching direction.

6. An automatic centrifugal fluidizing barrel processing apparatus according to claim 1, wherein said barrel handling mechanism comprises a barrel carrying conveyor placed below said revolutionary shaft and extending in an approximately horizontal direction, which is perpendicular to said revolutionary shaft.

7. An automatic centrifugal fluidizing barrel processing apparatus, comprising:

a revolutionary shaft having a pair of disk members, horizontally held by a frame, and connected to a revolution driving source;

a plurality of pairs of rotary shafts which are rotatably held by said disk members and positioned on axes parallel to said revolutionary shaft and dividing a periphery of said revolutionary shaft equally;

a planetary moving mechanism which moves in conjunction with said revolutionary shaft and rotates said rotary shafts;

a plurality of airtight cylindrical barrels each having an engaging centering portion on both ends thereof and being capable of containing workpieces and polishing materials, each of said barrels is divided into a main cylindrical portion and a lid portion by an opening provided in parallel with a cylinder axis, and dovetail flanges which closely contact each other extend at said opening and a contact surface of at least one of said dovetail flanges is covered with an elastic sealing layer, and said dovetail flanges are pinched together by a clamp member having a dovetail groove which corresponds to said dovetail flanges;

a barrel pinching mechanism which detachably pinches said barrels by moving, in the longitudinal direction, pinching shafts which are installed in said pairs of rotary shafts in a manner to permit axial sliding, and engaging said pinching shafts with said engaging centering portions;

a barrel handling mechanism which separately handles to carry out a treated barrel released at a predetermined stop phase of said disk members and to carry in an untreated barrel to be installed.

8. An automatic centrifugal fluidizing barrel processing apparatus according to claim 7, wherein said elastic sealing layer is formed integrally with a rubber lining layer covering an inner surface of at least one of said main cylindrical portion and said lid portion.

9. An automatic centrifugal fluidizing barrel processing apparatus, comprising:

a revolutionary shaft having a pair of disk members, held by a frame, and connected to a revolution driving source;

a plurality of pairs of rotary shafts which are rotatably held by said disk members and positioned on axes parallel to said revolutionary shaft and dividing a periphery of said revolutionary shaft equally;

a planetary moving mechanism which moves in conjunction with said revolutionary shaft and rotates said rotary shafts, said planetary moving mechanism comprising a sun gear which is formed in at least one of said disk members, attached to said revolutionary shaft in an airtight gear room lubricated in an oil bath in a manner to permit relative rotation, and fixed to said frame; a coupling ring which is attached to said revolutionary shaft in a manner to permit relative rotation, which couples said frame with said sun gear, and which holds an end surface of said at least one of said disk members on the opposite side to the barrel pinching side so as to permit relative rotation; and rotary gears each attached to an outer circumference of each of said rotary shafts in said gear room in a manner to inhibit relative rotation; and planetary gears which engage with said sun gear and said rotary gears in said gear room;

a plurality of airtight cylindrical barrels each having an engaging centering portion on both ends thereof and being capable of containing workpieces and polishing materials;

a barrel pinching mechanism which detachably pinches said barrels by moving, in the longitudinal direction, pinching shafts which are installed in said pairs of rotary shafts in a manner to permit axial sliding and engaging said pinching shafts with said engaging centering portions;

a barrel handling mechanism which separately handles to carry out a treated barrel released at a predetermined stop phase of said disk members and to carry in an untreated barrel to be installed.

10. An automatic centrifugal fluidizing barrel processing apparatus, comprising:

a revolutionary shaft having a pair of disk members, held by a frame, and connected to a revolution driving source;

a plurality of pairs of rotary shafts which are rotatably held by said disk members and positioned on axes parallel to said revolutionary shaft and dividing a periphery of said revolutionary shaft equally;

a planetary moving mechanism which moves in conjunction with said revolutionary shaft and rotates said rotary shafts; a plurality of airtight cylindrical barrels each having an engaging centering portion on both ends thereof and being capable of containing workpieces and polishing materials;

a barrel pinching mechanism which detachably pinches said barrels by moving, in the longitudinal direction, pinching shafts which are installed in said pairs of rotary shafts in a manner to permit axial sliding, and engaging said pinching shafts with said engaging centering portions, said barrel pinching mechanism comprising a spring which is installed in each of said rotary shafts and urges each of said pinching shafts in a barrel pinching direction; a pinch-releasing actuator fixed to said frame and moving ends of said pinching shafts on the opposite side to the barrel pinching side, which protrude from said disk members, in opposite directions to the barrel pinching sides at a stop phase of said disk members, said ends of said pinching shafts on the opposite side to the barrel pinching side each have a flange extending in a radial direction of said revolutionary shaft, and a fore end of a rod of said pinch releasing actuator has a claw through which said flange can move in the circumferential direction of said revolutionary shaft and which can withdraw said flange in the opposite direction to the barrel pinching direction;

a barrel handling mechanism which separately handles to carry out a treated barrel released at a predetermined stop phase of said disk members and to carry in an untreated barrel to be installed.

11. An automatic centrifugal fluidizing barrel processing apparatus, comprising:

a revolutionary shaft having a pair of disk members, horizontally held by a frame, and connected to a revolution driving source;

a plurality of pairs of rotary shafts which are rotatably held by said disk members and positioned on axes parallel to said revolutionary shaft and dividing a periphery of said revolutionary shaft equally;

a planetary moving mechanism which moves in conjunction with said revolutionary shaft and rotates said rotary shafts;

a plurality of airtight cylindrical barrels each having an engaging centering portion on both ends thereof and being capable of containing workpieces and polishing materials;

a barrel pinching mechanism which detachably pinches said barrels by moving, in the longitudinal direction, pinching shafts which are installed in said pairs of rotary shafts in a manner to permit axial sliding, and engaging said pinching shafts with said engaging centering portions;

a barrel handling mechanism which separately handles to carry out a treated barrel released at a predetermined stop phase of said disk members and to carry in an untreated barrel to be installed, said barrel handling mechanism comprising a barrel carrying conveyor placed below said revolutionary shaft and extending in an approximately horizontal direction which is perpendicular to said revolutionary shaft.

* * * * *